United States Patent [19]

Ito

[11] Patent Number: 4,809,050

[45] Date of Patent: Feb. 28, 1989

[54] COPYING MACHINE FOR FORMING AN IMAGE OF A DOCUMENT AT VARIOUS MAGNIFICATIONS

[75] Inventor: Masazumi Ito, Toyohashi, Japan

[73] Assignee: Minolta Camera Kabushiki Kaisha, Osaka, Japan

[21] Appl. No.: 95,145

[22] Filed: Sep. 10, 1987

[30] Foreign Application Priority Data

Sep. 11, 1986 [JP] Japan ..... 61-215425
Sep. 11, 1986 [JP] Japan ..... 61-215426

[51] Int. Cl.[4] ..... G03G 15/00; B65H 03/44; B65H 07/02

[52] U.S. Cl. ..... 355/14 SH; 355/14 R; 271/9; 271/259

[58] Field of Search ..... 355/3 SH, 14 SH, 3 R, 355/14 R; 271/3.1, 9, 258, 259

[56] References Cited

U.S. PATENT DOCUMENTS

| | | | |
|---|---|---|---|
| 3,684,373 | 8/1972 | Berge et al. . | |
| 3,689,143 | 9/1972 | Case et al. . | |
| 4,108,427 | 8/1978 | Komori et al. . | |
| 4,265,440 | 5/1981 | Shibazaki et al. . | |
| 4,406,537 | 9/1983 | Mori | 355/3 SH X |
| 4,442,505 | 4/1984 | Takano | 355/14 R X |
| 4,455,081 | 6/1984 | Yoshimura et al. . | |
| 4,484,734 | 11/1984 | Tsudaka et al. | 271/9 |
| 4,568,181 | 2/1986 | Nishiyama | 355/14 R X |
| 4,575,227 | 3/1986 | Ito et al. . | |
| 4,579,445 | 4/1986 | Hasegawa | 355/14 R |
| 4,647,188 | 3/1987 | Komiya et al. | 355/14 R X |

FOREIGN PATENT DOCUMENTS

| | | | |
|---|---|---|---|
| 130838 | 1/1982 | Japan | 271/9 |
| 31834 | 2/1983 | Japan | 271/9 |
| 31833 | 2/1983 | Japan | 271/9 |
| 116654 | 12/1985 | Japan | 271/9 |
| 192637 | 8/1986 | Japan | 271/9 |

OTHER PUBLICATIONS

IBM Technical Disclosure Bulletin, vol. 17, No. 9., Feb. 1975, pp. 2690–2690A.

*Primary Examiner*—A. T. Grimley
*Assistant Examiner*—Ed Pipala
*Attorney, Agent, or Firm*—Burns, Doane, Swecker & Mathis

[57] ABSTRACT

A copying machine is disclosed which has a plurality of copying paper feeding means, means for detecting a document size to be copied, means for designating a copying magnification and means for designating one paper feeding means to be used preferentially.

Further, the copying machine has calculation means for calculating the most suitable size based on the document size and the designated magnification.

One paper feeding means is automatically selected referring to data corresponding about the document size, the most suitable paper size and the preferential paper feeding means and so on.

16 Claims, 24 Drawing Sheets

COPYING MACHINE FOR FORMING AN IMAGE OF A DOCUMENT AT VARIOUS MAGNIFICATIONS

BACKGROUND OF THE INVENTION

1. Field of the Invention

The present invention is related to an electro-photographical copying machine having a function for selecting copying papers suitable for documents to be copied automatically.

2. Description of the Prior Art

There has been known an electro-photographical copying machine having such an auto-paper selection (APS) function as mentioned above.

In this type of copying mahcine, a size of document is detected at first when said APS mode is designated. If it provides an auto-document feeder (ADF), each document size is detected accompanied with operation of ADF.

Thereafter, one of paper feeding means wherein copying papers having a size suitable for the detected document size is selected before starting copying operation.

Meanwhile, users are apt to designate a paper size corresponding to a document size from habit upon copying although APS mode is designated, since they know sizes of documents to be copied beforehand usually. When copying operation is started in APS mode under such a situation mentioned above, it may be caused contrary to user's intention that the paper feeding means designated by the user is switched to another one wherein copying papers having the same size designated are contained, since suitable paper feeding means is determined, irrespective of the designation by the user, according to predetermined procedure at the side of the copying machine. This gives confusions or strange feeling to the user.

Further, there may be such a case in that a user wishes to use a favorable paper feeding means preferentially than other paper feeding means even in APS mode which may be convenient to use, free from jamming or has a large volume for containing copying papers.

SUMMARY OF THE INVENTION

An essential object of the present invention is to provide an electro-photographic copying mahcine having an improved operability wherein suitable paper feeding means can be designated preferentially other than the one selected in APS mode which might meet to use's intention.

Another object of the present invention is to improve operability of copying in APS mode.

BRIEF DESCRIPTION OF THE DRAWINGS

Further objects and characteristics of the present invention will be understood with reference to the following description of the preferred embodiments and the accompanying drawings wherein.

DETAILED DESCRIPTION OF THE PREFERRED EMBODIMENTS

The preferred embodiment of the present invention will be explained in the following order:

(a) Composition of copying machine
(b) Operation panel
(c) Composition of controller of copying machine
(d) Operation of copying machine
(d-1) Main routine
(d-2) Paper select operation
(d-3) Processing about alteration key
(d-4) Alteration of copy-magnification in auto-paper selection (APS) mode
(d-5) Alteration of copy-magnification in auto-magnification selection (AMS) mode
(d-6) Reservation function for starting auto-document feeder (ADF)
(d-7) Copying operation
(e) Operation of auto-document feeder (ADF)
(Communication with other CPUs)

(a) Composition of copying machine

Figure 1:
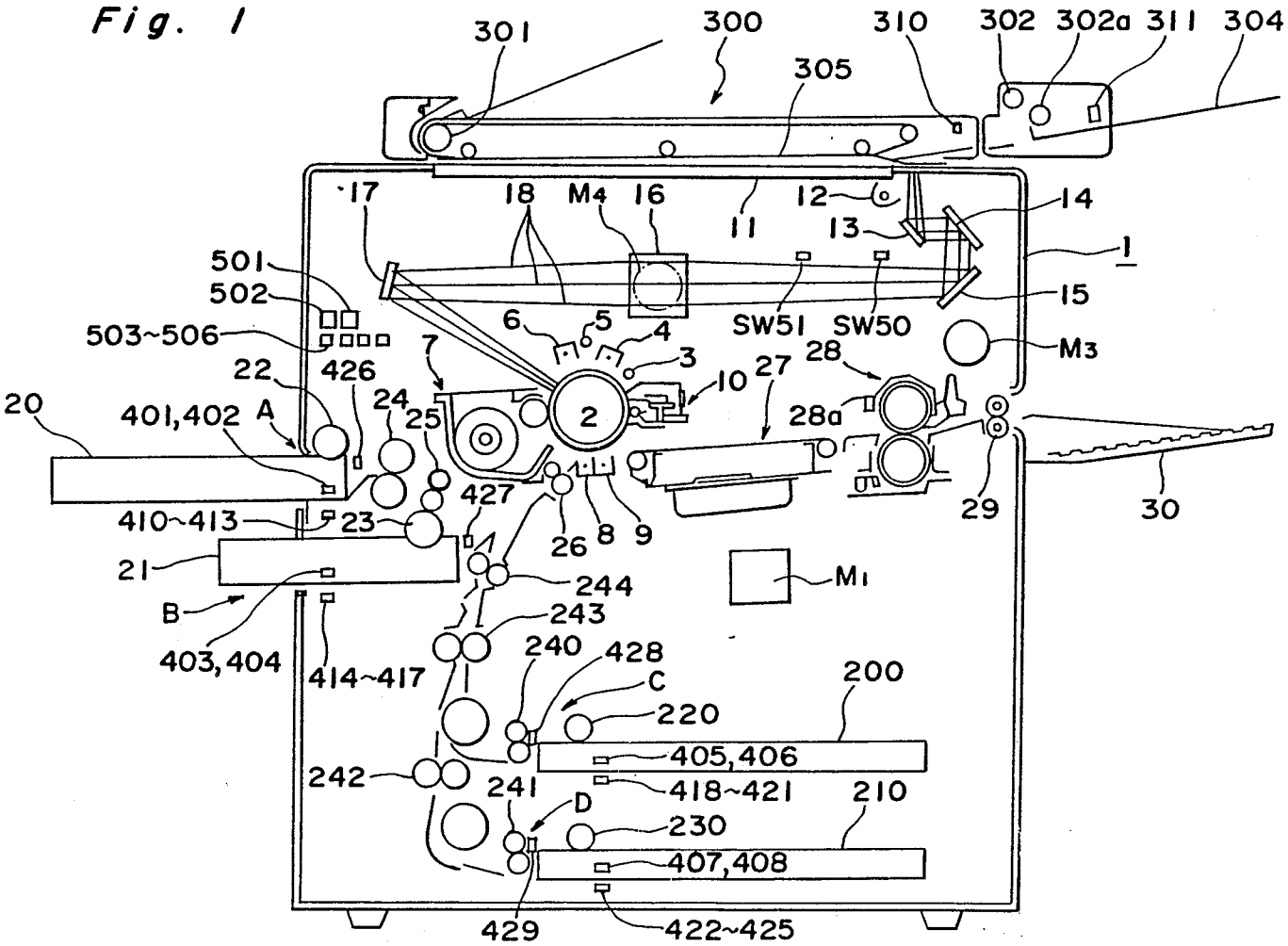
FIG. 1 is a schematic cross-sectional view of a copying machine according to the present invention, FIGS. 2(*a*) and 2(*b*) are perspective views showing mechanism for setting colors of copying papers.

FIG. 1 shows a schematic sectional view of an electro-photographic copying machine.

The copying mechanism employed in this copying machine is essentially same to that of a conventional copying machine.

In the center portion of the housing 1 of the copy machine, there is provided a photo-receptor drum 2 which is driven to rotate, for example, in an anti-clockwise direction. A main erasing lamp 3, a sub-electrifying charger 4, a sub-erasing lamp 5, a main eletrifying charger 6, a developing apparatus 7, a transferring charger 8, a charger 9 for separating the copying paper from the photo-receptor drum and a cleaning apparatus 10 of blade type are arranged around the drum 2 in the direction of rotation thereof. The photo receptor drum 2 has a photo sensitive layer made of a photo sensitive material such as Selenium on the surface thereof and, during every copying cycle, is irradiated by the erasing lamps 3 and 5, is electrified by the chargers 4 and 6 and, then, is exposed to form a latent image of a document image by an optical system which will be explained herein below. A motor M1 is provided for driving the drum 2 in the housing.

The optical system is provided below a document platen 11 made of glass so as to scan a document set thereon. It includes a light source 12, first, second and third mirrors 13, 14 and 15, a projecting lens 16 and fourth mirror 17. The document image is projected onto the drum 2 via the mirrors 13, 14, 15 and 17. A standard position switch SW50 is provided for detecting whether the optical system is positioned at a predetermined start position upon scanning the document thereby. The copying magnification is set by moving the projecting lens 16 in the direction of the optical axis thereof with use of a motor M4. A motor M3 is provided for driving the optical system upon scanning the document. As is well known to those skilled in the art, when the magnification is set to "n", the light source 12 and the first mirror 13 are moved to the left side of FIG. 1 at a speed of (V/n) by the motor M3 corresponding to the circumferential rotation speed V of the drum 2 and, at the same time, the second and third mirrors 14 and 15 are moved to the left side at a speed of (V/2n). The document image is projected on the drum 2 as slit images by the fourth mirror 17 according to the movement of these mirrors and the light source.

Automatic paper feeding cassettes 20 and 21 are set inserted into first and second paper feeding apertures A and B, respectively, which are formed on the left side wall of the housing. Further, in the bottom portion of the housing 1, there are provided automatic paper feeding cassettes 200 and 210 which are set toward third and fourth paper feeding apertures C and D, respectively, which are provided in the bottom portion of the housing 1. Each copying paper contained in either one of these cassettes 20, 21, 200 or 210, when it is selected, is fed to a pair of timing rollers 26 kept in a tight contact state by corresponding one feeding roller 22, 23, 220 or 230 and corresponding at least one pair of feeding rollers 24, 25, 240, 241, 242, 243 and 244. The copying paper fed thereto is kept stopped until the next copying cycle is started.

Upon transferring toner image, the copying paper fed by the timing rollers 26 is contacted to the surface of the drum tightly and the tonor image is transferred onto the copying paper by corona discharge caused through the transferring charger 8. Thereafter, the copying paper onto which the toner image has been transferred is separated from the drum by corona discharge due to the separating charger 9 and the stiffness of the paper. Successively, the copying paper is suctioned onto a transportating belt 27 by air suction means (not shown) and transported to right side according to the run of the belt being rotated in a clockwise direction. Then, the toner image transferred is fixed on the copying paper when it passes through a thermal fixing apparatus 28. The copying paper, then, is passed through a pair of discharging rollers 29 and discharged onto a tray 30 mounted on the right side wall of the housing or a sorter (not shown). A sensor **28*a* for detecting temperature of the fixing apparatus 28** is provided near the fixing apparatus.

Combination switches (401, 402), (403, 404), (405, 406) and (407, 408) are lead-switches mounted on respective cassettes 20, 21, 200 and 210 which are provided for detecting individual kinds (colors) of the copying papers contained therein.

Figure 2A:
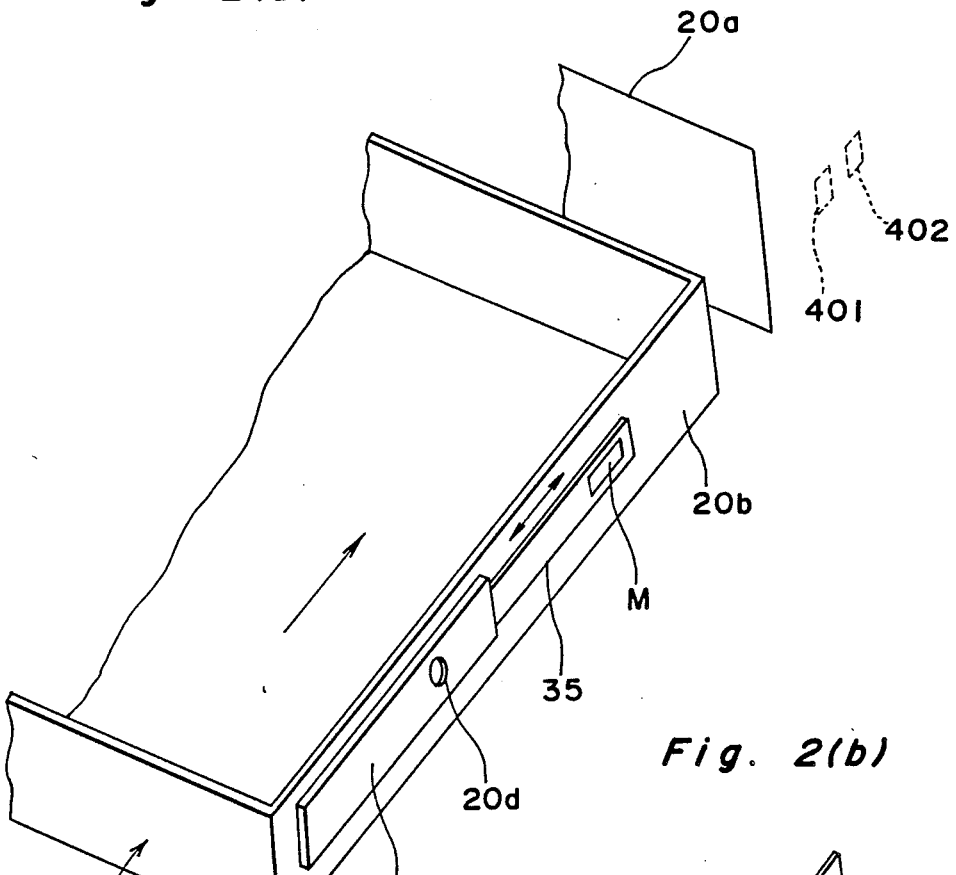
Figure 2B:
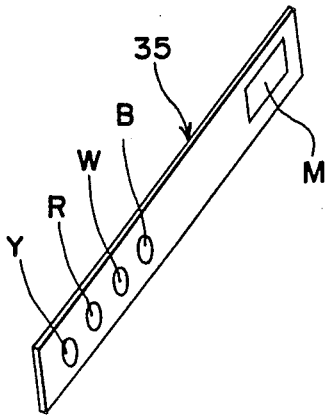

The detection of the kind (color) of copy paper set in the cassette 20 is done by the kind detecting switches 401 and 402 as follows; As shown in FIG. 2(*a*), an elongated indication plate 35 at one end of which a magnet M is provided is mounted on the outer surface of the side wall **20*b* of the cassette 20 which is parallel to the insertion direction of the cassette 20 into the aperture 20*a*. On the other side of the indication plate 35, as shown in FIG. 2**(*b*), small circles B, W, R and Y colored in black, white, red and yellow are aligned in the insertion direction of the cassette 20 at a predetermined pitch. The portion of the indicating plate 35 including colored circles is inserted slidably between the side wall **20*b* and a guide plate 20*c* fixed thereto. Therefore, the position of the magnet M relative to the side wall 20*b* is changed when the indication plate 35 is operated therealong. This relative position of the magnet M to the side wall 20*a* can be detected from ON-OFF states of the kind detection switches 401 and 402 when the cassette 20 is inserted from the insertion aperture 20*a*. The indication plate 35 is positioned so as for one of colored circles desired as to coincide with a circular window formed on the guide plate 20*c*** for showing the color chosen.

Other cassettes 21, 200 and 210 have a structure similar to that of the cassette 20.

Referring to FIG. 1 again, each group of paper-size detection switches (410~413), (414~417), (418~421) or (422~425) is comprised of micro-switches arranged aligned along the direction of width of each paper feeding aperture A, B, C or D. Each group of micro-switches detects the paper size of the copying paper contained in the cassette and the orientation thereof which is defined with respect to the feeding direction of the copying paper. Hereinafter, the state wherein the copying paper is so set for the lengthwise direction thereof as to coincide with the feeding direction is referred to "lengthwise set" and the term "sideways set" indicates the state wherein the lengthwise direction is perpendicular to the insertion direction. Available paper sizes, namely sizes of papers being able to set in either one of cassettes are, for example, [A3], [A4], [A5], [B4] and [B5]. With respect to sizes [A4] and [B5], either of "lengthwise set" and "sideways set" can be selected.

Figure 5:
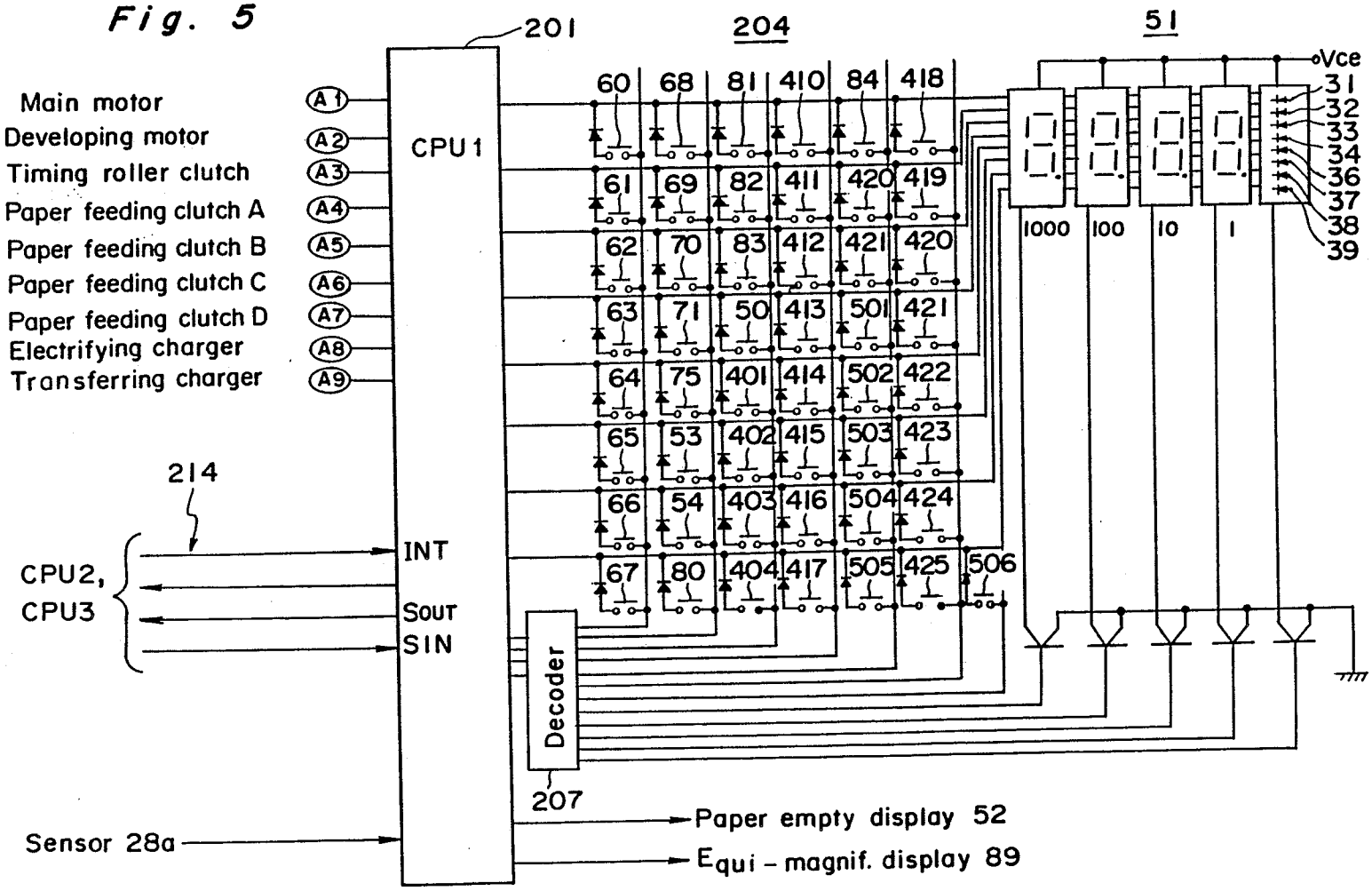
FIG. 5 is a block diagram of a control circuit including CPU 1 for controlling the main part of the copying machine.

The size and orientation of the copying paper are detected from ON-OFF state of each detection switch group (410~413), (414~417), (418~421) or (422~425) as a code of 4 bits and this code obtained is memorized in a RAM provided in CPU 1 of the controller (see FIG. 5).

An example of code table obtained with use of switches 410~413 is shown in Table 1. In this Table 1, "0" and "1" denote ON and OFF states of a switch, respectively. If all of switches 410~413 are in OFF states, it indicates that the cassette 20 is not inserted in the paper feeding aperture A.

TABLE 1

| Decimal Code | Binary Code SW413 | SW412 | SW411 | SW410 | Paper size |
|---|---|---|---|---|---|
| 0 | 0 | 0 | 0 | 0 | |
| 1 | 0 | 0 | 0 | 1 | |
| 2 | 0 | 0 | 1 | 0 | |
| 3 | 0 | 0 | 1 | 1 | |
| 4 | 0 | 1 | 0 | 0 | B5 Lengthwise |
| 5 | 0 | 1 | 0 | 1 | A4 Lengthwise |
| 6 | 0 | 1 | 1 | 0 | B4 Lengthwise |
| 7 | 0 | 1 | 1 | 1 | A3 Lengthwise |
| 8 | 1 | 0 | 0 | 0 | |
| 9 | 1 | 0 | 0 | 1 | |
| 10 | 1 | 0 | 1 | 0 | B5 Sideways |
| 11 | 1 | 0 | 1 | 1 | A4 Sideways |
| 12 | 1 | 1 | 0 | 0 | |
| 13 | 1 | 1 | 0 | 1 | |
| 14 | 1 | 1 | 1 | 0 | |
| 15 | 1 | 1 | 1 | 1 | No cassette |

Further, respective switches 426 to 429 are provided for detecting whether any copying paper is contained in the corresponding cassette 20, 21, 200 or 210.

Above the first paper feeding aperture A, an alteration key 501 for APS (auto-paper selection), and alteration key 502 for AMS (auto-magnitude selection) and setting keys 503, 504, 505 and 506 for designating a cassette to be selected preferentially are arranged. Functions of these keys will be stated later in detail.

On the top deck of the housing 1, there is provided an automatic document feeding apparatus (ADF) 300 for setting each document on the document glass platen 11 automatically.

In the ADF, a sensor 310 is provided for detecting whether a document is fed towards the platen 11 and a sensor (not shown) is provided for detecting whether there is a document on the platen 11. A motor 301 is provided for driving a document transporting belt 305 and a motor 302 is provided for driving a paper feeding roller 302*a*.

Upon copying, the ADF is started to operate at first when a print switch (See 50 in FIG. 3) on the operation panel of the copying machine is operated which will be explained in the section (b). Namely, one of documents set on a document array 304 is fed by the rotating feeding roller 302*a* towards the transporting belt 305 and is moved to a predetermined position on the document platen 11. During feeding the document, the sensor 310 detects a size of the document. When the belt is stopped after setting the document, one copying cycle is started. This copying operation is carried out when the ADF is in the closed state and a document is on the document platen (ADF When the ADF is opened and a document is set on the document platen manually, the ADF mode is cancelled and, in stead thereof, usual copying cycle is carried out after the ADF is closed. The APS mode is also cancelled if the ADF mode is cancelled, since it becomes impossible to detect the size of a document to be copied.

(b) Operation panel

Figure 3:
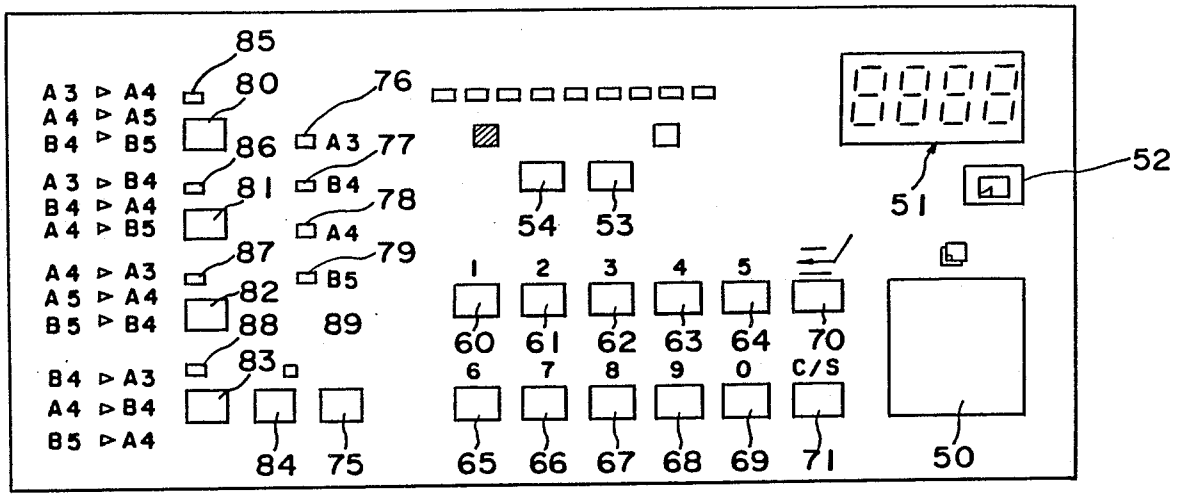
FIG. 3 is a plan view of an operation panel of the copying machine according to the present invention.

FIG. 3 shows an operation panel of the copying machine according to the present invention.

There are arranged a variety of keys, switches and display means on the operation panel as follows;

50: Print switch for starting a copying cycle,

51: LED numeral display for indicating the number of papers already copied,

52: Display for indicating Paper-Empty,

53: Up-key for increasing the amount of exposure stepwise,

54: Down-key for decreasing the amount of exposure stepwise,

60 through 69: Ten-keys for entering copy information such as the number of papers to be copied,

70: Interruption key for interrupting copying operation,

71: Clear-stop key for stopping multi-copying cycle in the midway thereof and for clearing up numerals having been set,

75: Paper select key for designating a desirable paper size,

76 through 79: Displays for indicating individual sizes of A3, B4, A4 and B5,

80: Select key for selecting a reduction magnification from A3 size to A4 size,

81: Select key for selecting a reduction magnification from A3 size to B4 size,

82: Selecting key for selecting an enlargement magnification from A4 size to A3 size,

83: Select key for selecting an enlargement magnification from B4 size to A3 size,

84: Select key for selecting the equi-magnificaiton

85 through 88: Displays for indicating one of select keys 80 to 83 when operated,

89: Display for the select key 84 when operated.

Figure 4:
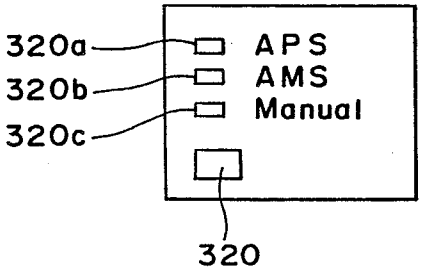
FIG. 4 is a plan view of an operation panel of ADF (anto-document feeder)

FIG. 4 shows an operation panel provided for the ADF 300. On the operation panel, there is provided a select key 320 for selecting either one or two modes among APS mode, AMS mode and manual mode. Three LED displays 320*a*, 320*b* and 320*c* are provided for indicating that the corresponding mode is selected. These modes can be designated in cyclic manner by operating the select key 320 until one of displays 320*a*, 320*b* and 320*c* corresponding to a desired mode is switched ON.

When the APS mode is selected, the most suitable paper size is automatically decided according to Table 2, based upon a document size detected by the ADF 300 and a copying magnification designated by an operator and a paper feeding aperture providing a cassette containing copying papers having the decided paper size is automatically selected in order to carry out one copying cycle. For instance, if the document size is "A3" and the designated magnification is in a range defined from 0.823 to 0.872, B4 size is selected according to Table 2.

TABLE 2

| Doc. Size | Mag. Zone 0.610~0.713 | 0.714~0.822 | 0.823~0.872 | 0.873~1.006 | 1.007~1.160 | 1.161~1.230 | 1.231~1.420 | 1.421~1.640 |
|---|---|---|---|---|---|---|---|---|
| B5 Lengthwise | B5 Lengthwise | B5 Lengthwise | B5 Lengthwise | B5 Lengthwise | A4 Lengthwise | B4 | B4 | A3 |
| A4 Lengthwise | B5 Lengthwise | B5 Lengthwise | B5 Lengthwise | A4 Lengthwise | B4 | B4 | A3 | — |
| B4 | B5 | A4 | B4 | B4 | A3 | — | — | — |

TABLE 2-continued

| Doc. Size | Mag. Zone | | | | | | | |
|---|---|---|---|---|---|---|---|---|
| | 0.610~0.713 | 0.714~0.822 | 0.823~0.872 | 0.873~1.006 | 1.007~1.160 | 1.161~1.230 | 1.231~1.420 | 1.421~1.640 |
| A3 | Lengthwise A4 | Lengthwise B4 | B4 | A3 | — | — | — | — |
| B5 | Lengthwise B5 | Lengthwise B5 | B5 | B5 | A4 | — | — | — |
| A4 | B5 | B5 | B5 | A4 | — | — | — | — |

Values of magnification which define individual zones in Table 2 can be altered arbitrarily with use of ten keys 60 to 69 after operation of the APS altering key 501. For example, Table 2 can be altered so as for B4 size to be selected in the case that the document size is A3 size (297 mm×420 mm) and the designated magnification is in a zone defined from 0.800 to 0.900. Details about the altering processing will be explained later.

Meanwhile, if the AMS mode is selected, the most suitable copying magnification is automatically calculated based on a document size detected by the ADF 300 and a size of copying paper designated by an operator and one copying operation is carried out at the magnification calculated. For example, if the document size is A3 (297 mm×420 mm) and the size of copying paper is B4 (257 mm×364 mm), the ratio in the lengthwise direction [(257/297)=0.865] of B4 size to A3 size and the ratio in the sideways direction [(364/420)=0.867] are calculated at first and the smaller one (=0.865) of them is determined to be the copying magnification at that time. This copying magnificaiton is a magnification capable of copying a document image onto a copying paper of B4 size without any defection.

Contrary to the above, there may be such a demand that an operator wishes to copy the document image at a magnification smaller than that obtained by the calculation mentioned above. For example, upon copying a document of A3 size (297 mm×420 mm) onto a copying paper of A4 size (210 mm×297 mm), a magnification of 0.693 [0.707×(90/100)] is demanded which is smaller than the magnification of 0.707 obtained when the AMS mode is selected. In order to correspond to such a demand as mentioned above, there is provided a way in which the copying magnification can be altered according to a demand by an operator in the AMS mode. This alteration is done by entering a desired ratio for alteration (for example 0.9 in the above case) with use of ten keys after operating the AMS alteration key 502. When said ratio for alteration has been set once, the copying magnification is automatically determined to the product obtained by multiplying a calculated ratio by the alteration ratio (0.9) in the AMS mode. The processing to be executed with respect to the alteration ratio will be explained in detail afterwards.

(c) Composition of the controller of the copying machine

FIG. 5 shows a connection relation of CPU 1 (201) as a controller for the copying machine with various input and output means. The main motor, motor for driving the developer, timing roller clutch, clutches for upper and lower paper feeding roller, electrifying charger, transferring charger and, via a decorder 207, the numeral display 51 of four figures and LED matrix (31 to 34, 36 to 39) are connected to output terminals of CPU 1. Further, the display 52 for indicating "Paper Empty" and display 89 for indicating "Equi magnification" are connected thereto. To input terminals of CPU 1, individual lines of a switch matrix 204 including sensors and keys (50, 53, 54, 60–71, 75, 80–84, 401–404, 410–417, 418–421, 422–425, 501, 502 and 503–506) are connected. Bus 214 is provided for communicating with other CPUs (CPU 2, CPU 3). The temperature sensor 28*a* of the thermal fixing apparatus 28 is also connected to an input port of CPU 21.

Figure 6:
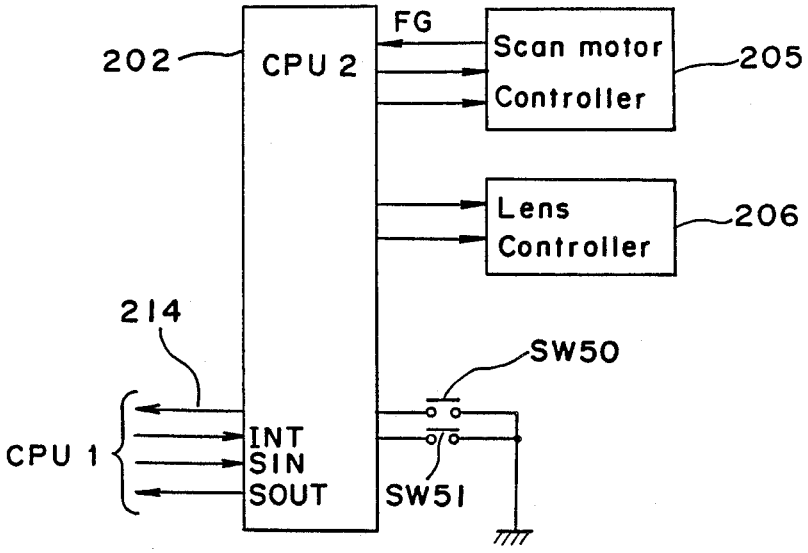
FIG. 6 is a block diagram of a control circuit including CPU 2 for controlling an optical system provided in the copying machine.

FIG. 6 shows a composition of input and output connection relation of CPU 2 (202) which is provided for controlling the optical system of the copying machine. Respective input and output ports of CPU 2 are connected to a control circuit 205 for controlling the scan motor M3, a lens control circuit 206 for controlling the motor M4 for driving the projection lens 16. Signals from the standard position detecting switch SW 50 and the switch 51 for generating a timing signal in order to drive the timing roller 26 upon copying at the equi-magnification are also input to CPU 2. This CPU 2 communicates with CPU 1 through bus 214 as mentioned above.

Figure 7:
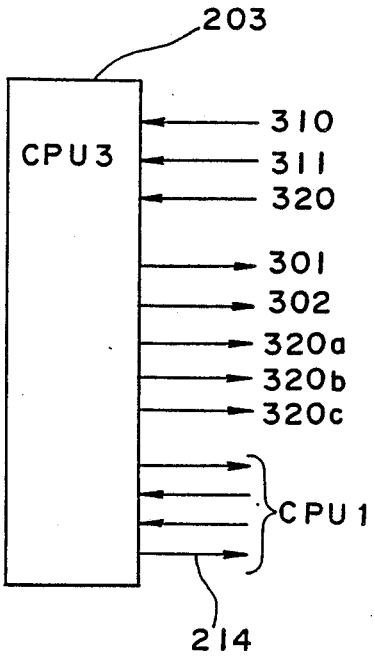
FIG. 7 is a block diagram of a control circuit including CPU 3 for controlling ADF.

FIG. 7 shows a composition of input and output connection relation of CPU 3 (203) which is provided for controlling the ADF 300. CPU 3 outputs signals to the motor 301 for driving the transporting belt and the paper feeding motor 302 and signals from the sensor 310 for detecting a document feed and the sensor 311 for detecting a document on the document platen are input thereto. The select key 320 and LED displays 320*a*, 320*b* and 320*c* are also connected thereto. CPU 3 communicates with CPU 1 through the bus 214 similarly to CPU 2.

(d) Operation of the copying machine

Hereinafter, flow charts of programs to be executed by CPU 1 for controlling the copying machine 1 are explained.

(d-1) Main Routine

Figure 8:
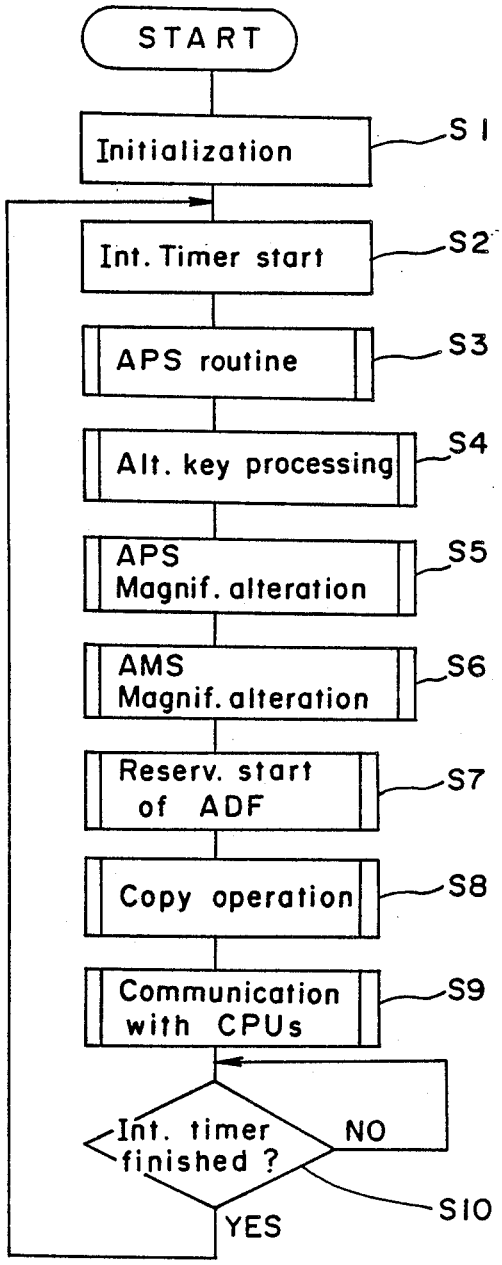
FIG. 8 is a flow chart of a main routine program for controlling the copying machine, FIGS. 9(*a*) and 9(*b*) show a flow chart of PAPER SELECT subroutine.

FIG. 8 shows the main routine of CPU 1. When the program is started, CPU 1 is initialized by clearing up RAM therein and setting various registers and various apparatuses are set to their initial modes at step S1, respectively. At the next step S2, an internal timer, which is provided in CPU 1 and initialized at step S1, is started. Then, various subroutines such as "paper-selecting" (S3), "Processing of altering key operation" subroutine (S4), "Magnification alteration in APS mode" subroutine (S5), "Magnification alteration in AMS mode" subroutine (S6), "Reserved start of ADF" subroutine (S7) and "Copying operation" subroutine (S8) are executed successively. After these subroutines, CPU 1 communicates with CPU 2 and CPU 3 at subroutine S9.

When all of these subroutines have been executed, the process returns from step S10 to step S2 at the timing of time-up of the internal timer having been set initially at step S2.

The time interval of one main routine is used as a unit for incrementing or decrementing various timers provided in individual subroutines. Namely, individual timers count the number of repetition of the main routine in order to decide respective time-overs.

(d-2) Paper selecting subroutine

Figure 9A:
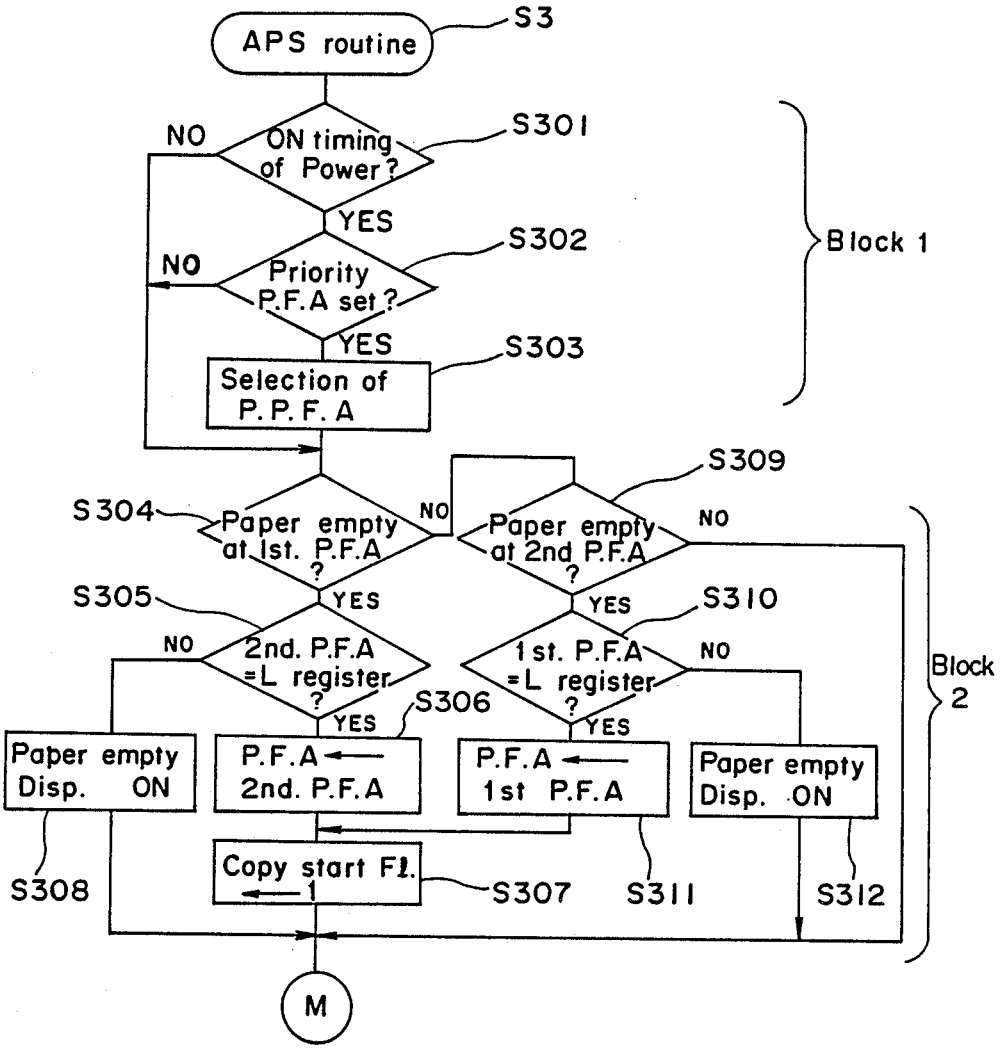
Figure 9B:
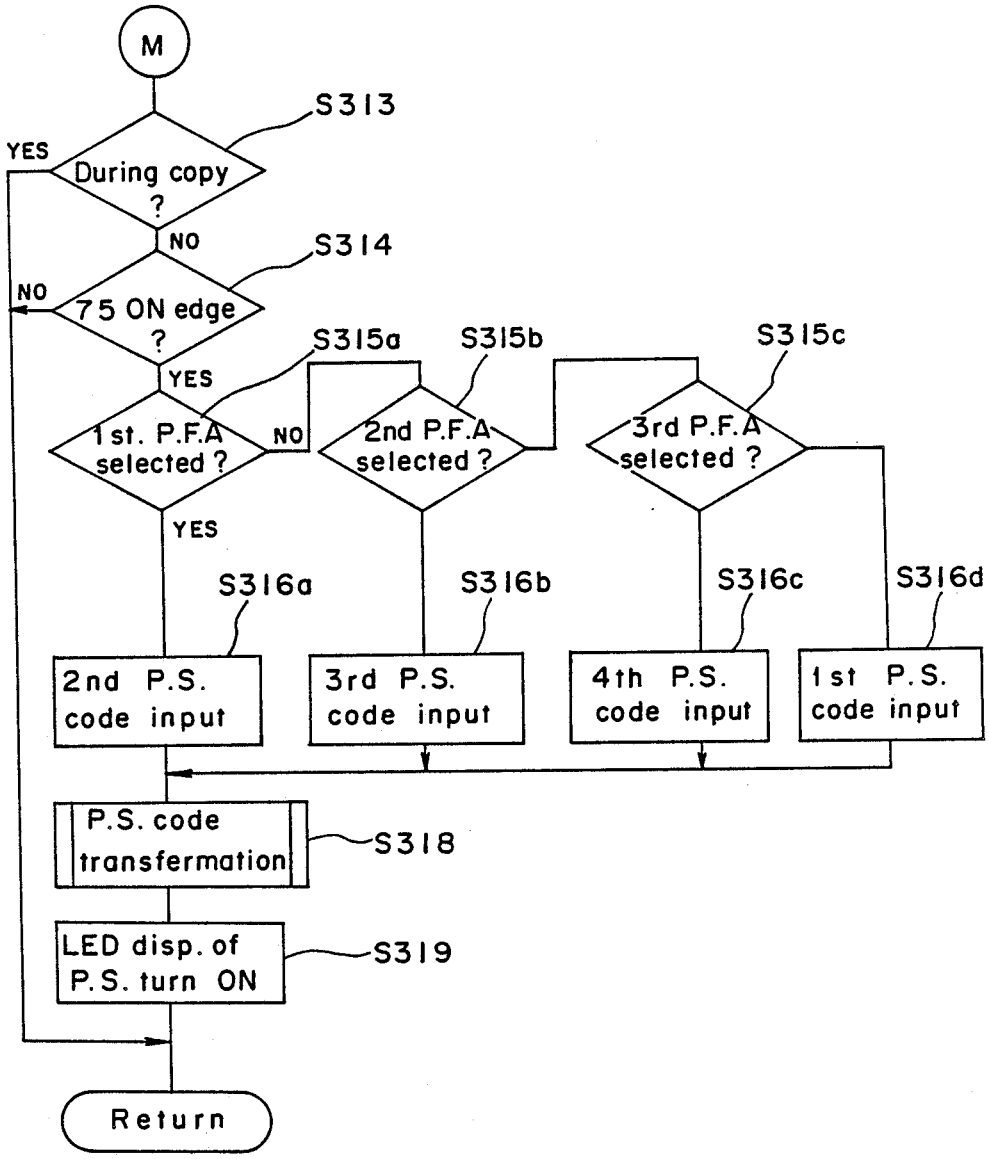

FIGS. 9(*a*) and 9(*b*) show a flow chart of paper selecting subroutine S3.

As shown in the block 1 of FIG. 9(*a*), if a preference paper feeding aperture has been designated after the power switch was switched ON, the paper feeding aperture is selected (steps S301, S302 and S303). The preference paper feeding aperture is designated by setting keys 503, 504, 505 and 506 provided therefor. For example, if the setting key 503 is operated, the first paper feeding aperture A is selected as the preference aperture. Similarly, the second, third and fourth paper feeding apertures B, C, and D are selected as preference paper feeding apertures by operating setting keys 504, 505 and 506, respectively.

Figure 16:
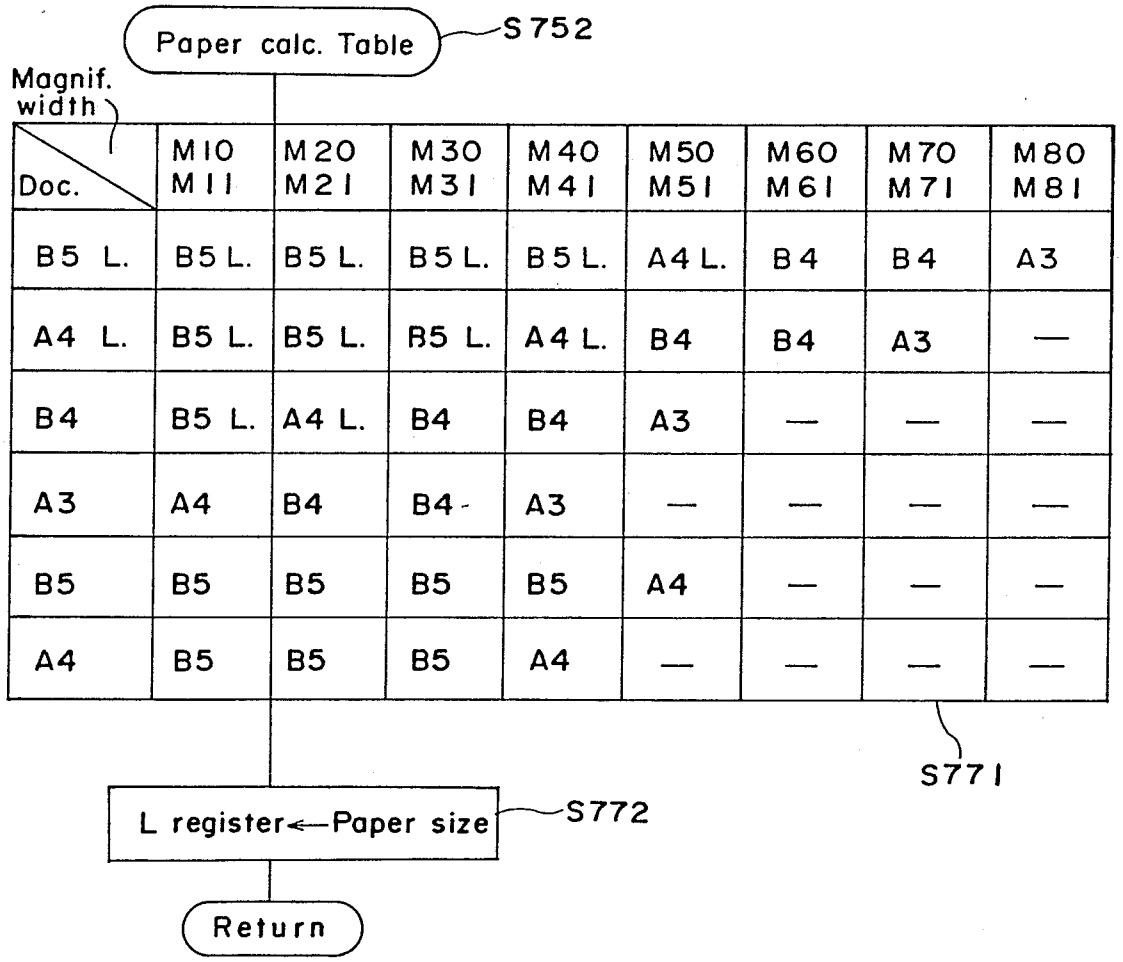
FIG. 16 is a flow chart of subroutine for selecting a suitable paper size with use of a paper calculation table, FIGS. 17(*a*), 17(*b*) and 17(*c*) show a flow chart of COPYING OPERATION routine.

Next, in the block 2, when the first cassette 20 inserted into the first paper feeding aperture A as the preference one becomes empty in the mid-way of copying (step S304), the size of copying paper contained in the second cassette 21 inserted into the second paper feeding aperture B is compared with a suitable paper size obtained from a research subroutine shown in FIG. 16 (step S305). If the former paper size does not coincide with the latter paper size, the paper empty display 52 is turned ON and the copying operation is stopped at once (S305, S308).

On the contrary to the above, if the paper size of the second cassette coincides with the suitable one, the second paper feeding aperture B is selected at step S306, COPY START flag is set to "1" at step S307 and the copying operation is continued as it is.

Meanwhile, if the second cassette becomes empty in the midway of the copying operation (step S309), the paper size of the first cassette is compared with a suitable paper size obtained from the table of FIG. 16 at step S310. If the former does not coincide to the latter, the paper empty display 52 is turned on and the copying operation is stopped. If the former coincides to the latter, the firs paper feeding aperture A is selected at step S312, COPY START flag is set to "1" and the copying operation is continued.

In the case of the third or fourth paper feeding aperture C or D, other paper feeding aperture can be selected in a manner substantially same to the case of the first or second paper feeding aperture A or B when the cassette inserted in the third or fourth paper feeding aperture becomes empty in the midway of the copying operation.

Next, as shown in FIG. 9(*b*), if the paper selecting switch 75 is operated when the copying operation is not carried out (steps S313 and S314), it is decided at the timing of ON-edge thereof whether the first paper feeding aperture A is selected at the present time. If decided "YES" at step S315*a*, the second one is selected at step S316*a*. Similarly, if the second one is selected at the present time, the third one is selected (steps S315*b* and S316*b*). Also, if the third one is selected at the present and, if the fourth one is selected at the present time, the first one is selected at step 316*d*. Individual codes representing paper sizes corresponding to individual cassettes are read out at steps S316*a*, S316*b*, S316*c* and S316*d*, respectively. Then, a subroutine for transforming paper-size code (will be explained later) is executed at step S318 and either one of LED displays corresponding to the paper size selected is turned on at step S319.

Figure 10:
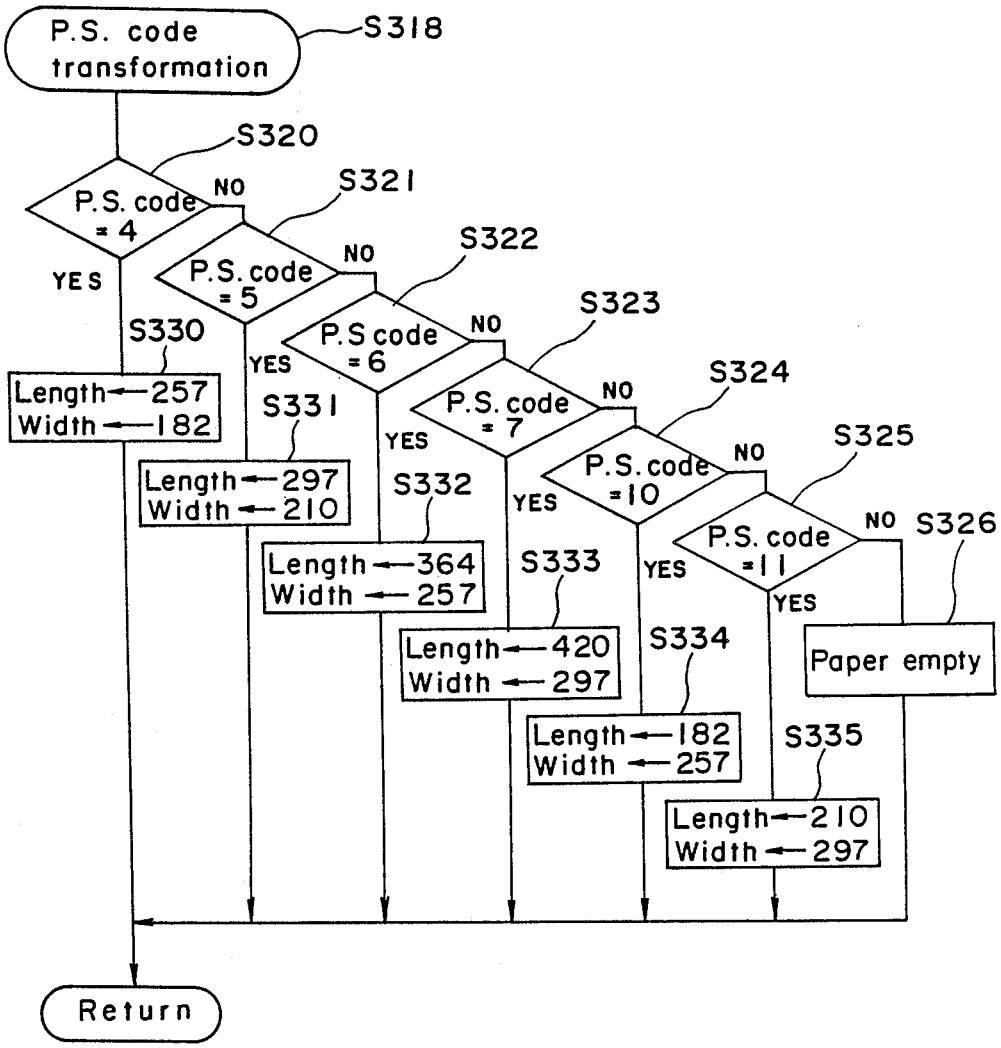
FIG. 10 is a flow chart of PAPER SIZE CODE TRANSFORMATION subroutine.

FIG. 10 shows a flow chart of the subroutine for transforming codes of paper sizes.

As stated regarding to the Table 1, paper sizes (and orientations) are coded. If the paper size code entered is "4", this indicates B5 size of lengthwise set and, therefore, 257 mm and 182 mm are memorized as the length and width of the paper at step S330, respectively.

If the paper size code is 5, 6, 7, 10 or 11, the paper size is decided to be A4 size of lengthwise set, B4 size of lengthwise set, A3 size of lengthwise set, B5 size of sideways set or A4 size of sideways set, and the length and width of the corresponding paper size are memorized, respectively (steps S330 through S335).

If the paper size code entered is not one of those listed above, it is decided at step S326 that there is not any available paper in the copying machine.

Although the document size is detected by the sensor 310 arranged in the ADF 300 in the preferred embodiment, it can be detected by size detecting sensors arranged beneath the document platen glass 11.

(d-3) Processing about alteration keys

Figure 11:
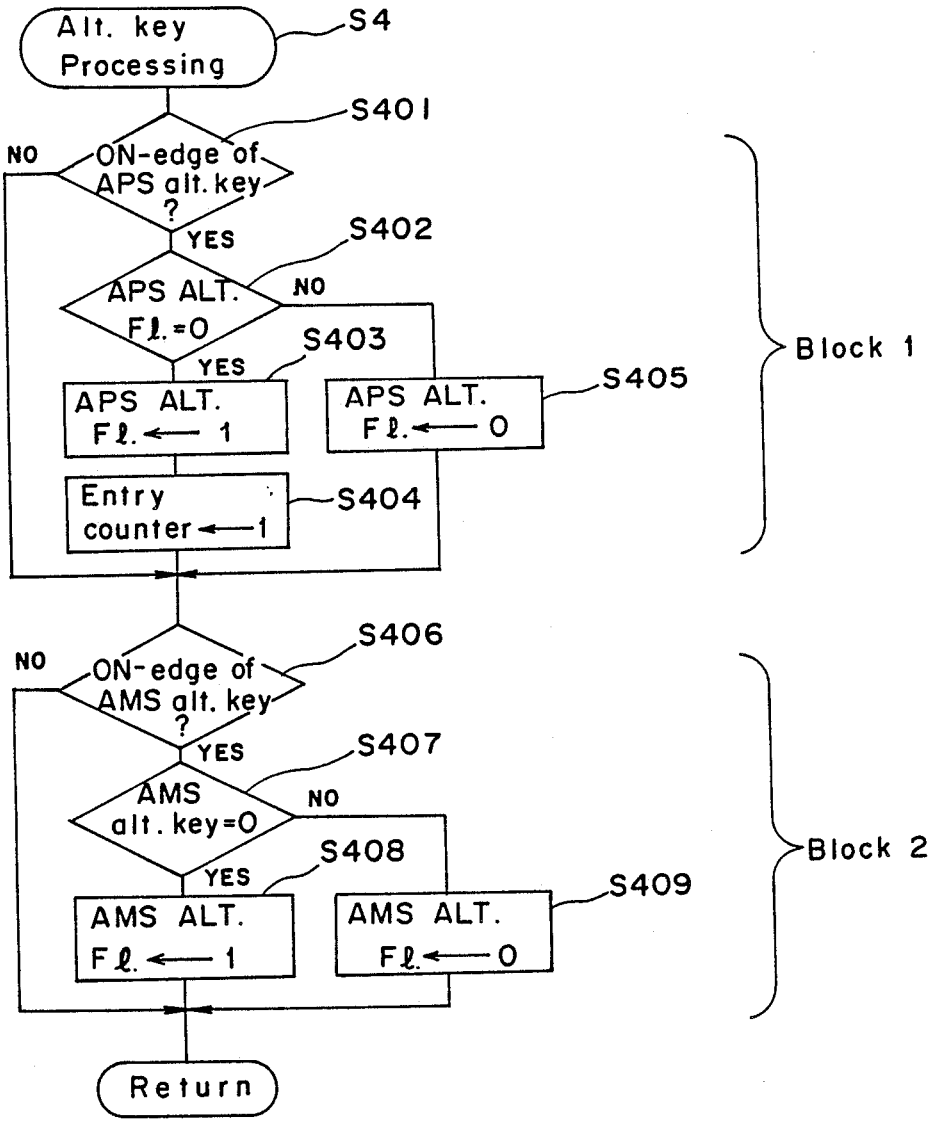
FIG. 11 is a flow chart of ALTERATION KEY PROCESSING subroutine.

FIG. 11 shows a flow chart of the subroutine S4 for processing with respect to alteration keys. In the block 1 of the subroutine S4, it is decided whether APS ALTERATION flag is equal to "0" at ON-edge of APS alteration key 501 (steps S401 and S402). If the APS ALTERATION flag is "0", it is set to "1" at step S403 and an entry-counter is also set to "1" at step S404. If it is decided that the APS ALTERATION flag 501 is not equal to "0", it is reset to "0" at step S405.

If an operator wishes to alter the magnification determined according to the AMS mode, AMS alteration key 502 is operated. And, at ON-edge thereof, it is decided whether AMS ALTERATION flag is equal to "0" at steps S406 and S407. If it is "0", AMS ALTERATION flag is set to "1" at step S408 and, if it is not "0", it is set to "0" at step S409.

(d-4) Alteration of magnification in APS mode

Figure 12:
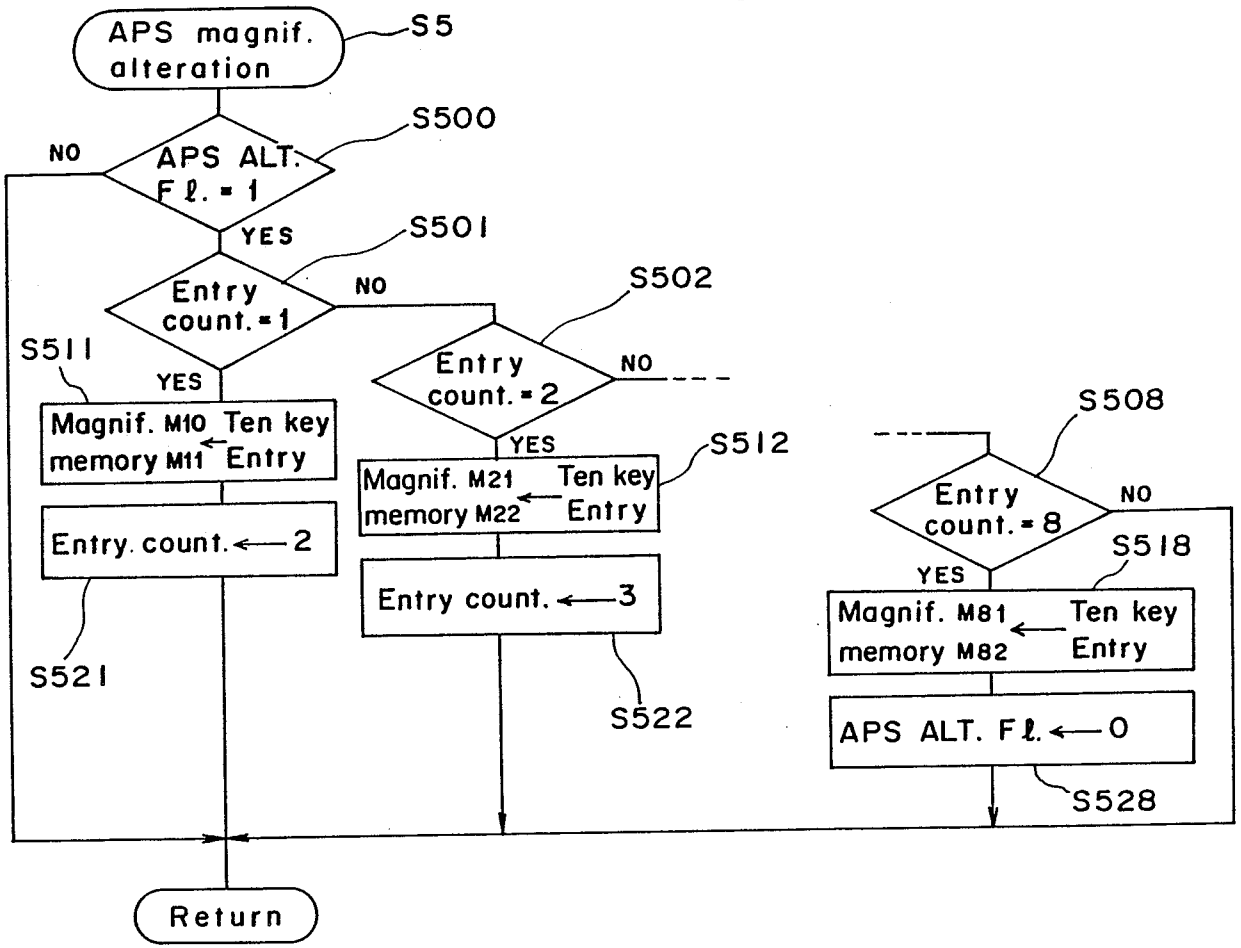
FIG. 12 is a flow chart of APS MAGNIFICATION ALTERATION subroutine.

FIG. 12 shows a flow chart of the subroutine S5 for altering the magnification determined according to the APS mode (hereinafter, referred to "APS magnification").

At first, it is decided whether the APS MAGNIFICATION ALTERATION flag is equal to "1" at step S500. If this flag is equal to "1" and the value of the entry counter is equal to "1", a value entered with use of ten keys 60 through 69 is stored in memories M10 and M11 provided therefor at step S511. Then, the process is returned after setting the entry counter to "2" at step S511.

If the count value of the entry counter is equal to "2" provided that the APS MAGNIFICATION ALTERATION flag is equal to "1", a value entered with use of ten keys 60~69 is stored in memories M21 and M22 at step S512 and, then, the entry counter is incremented by one at step S522.

Similar steps are repeated until the count value of the entry counter becomes equal to "8". When it becomes equal to "8", a value entered with use of ten keys 60~69 is stored in memories M81 and M82 and the APS MAGNIFICATION ALTERATION flag is set to "0" (at steps S508, S518 and S528).

Contrary to the above, if the APS MAGNIFICATION ALTERATION flag is not equal to "1" or the count value of the entry counter is neither one of "1" through "8", the process is returned.

Individual memories for storing values are provided in CPU 1. It is to be noted that values given in Table 2 are stored in respective memories M10 through M82 upon shipping the copying machine from factory.

(d-5) Alteration of AMS magnification

Figure 13:
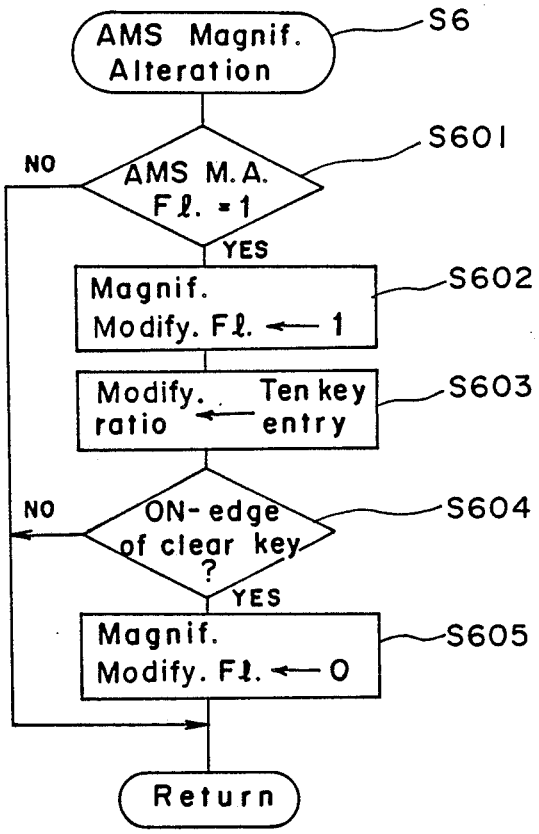
FIG. 13 is a flow chart of AMS MAGNIFICATION ALTERATION subroutine.

FIG. 13 shows a flow chart of the subroutine S6 provided for altering the magnification determined in the AMS mode.

At first, it is checked whether AMS MAGNIFICATION ALTERATION flag is equal to "1" at step S601. If it is "0", the process is returned. If it is equal to "1", the MAGNIFICATION MODIFICATION flag is set to "1" at step S602 and, then, a value entered with use of ten keys 60~69 is stored as a modification ratio in a memory provided therefor at step S603. Thereafter, when ON-edge of the Clear key 71 is detected at step S604, the MAGNIFICATION MODIFICATION flag is reset to "0" at step S605 and, then, the process is returned.

(d-6) Reservation function for starting ADF

As is well known, the copying machine has various waiting times which are needed for warming the thermal fixing apparatus 28 up to a predetermined temperature, for moving the projection lens 16 when the magnification is changed and the like and, therefore, during which copying operation is inhibited without accompanying any trouble of the machine.

The reservation function for starting ADF is such a function that allows operation of the print switch 50 in the ADF mode in order to set a document at the exposuring position by the ADF although the copying machine is in the waiting state as mentioned above and that makes copying operation start as soon as the waiting state has been cancelled by the completion of warming up or movement of the projection lens 16.

Figure 14:
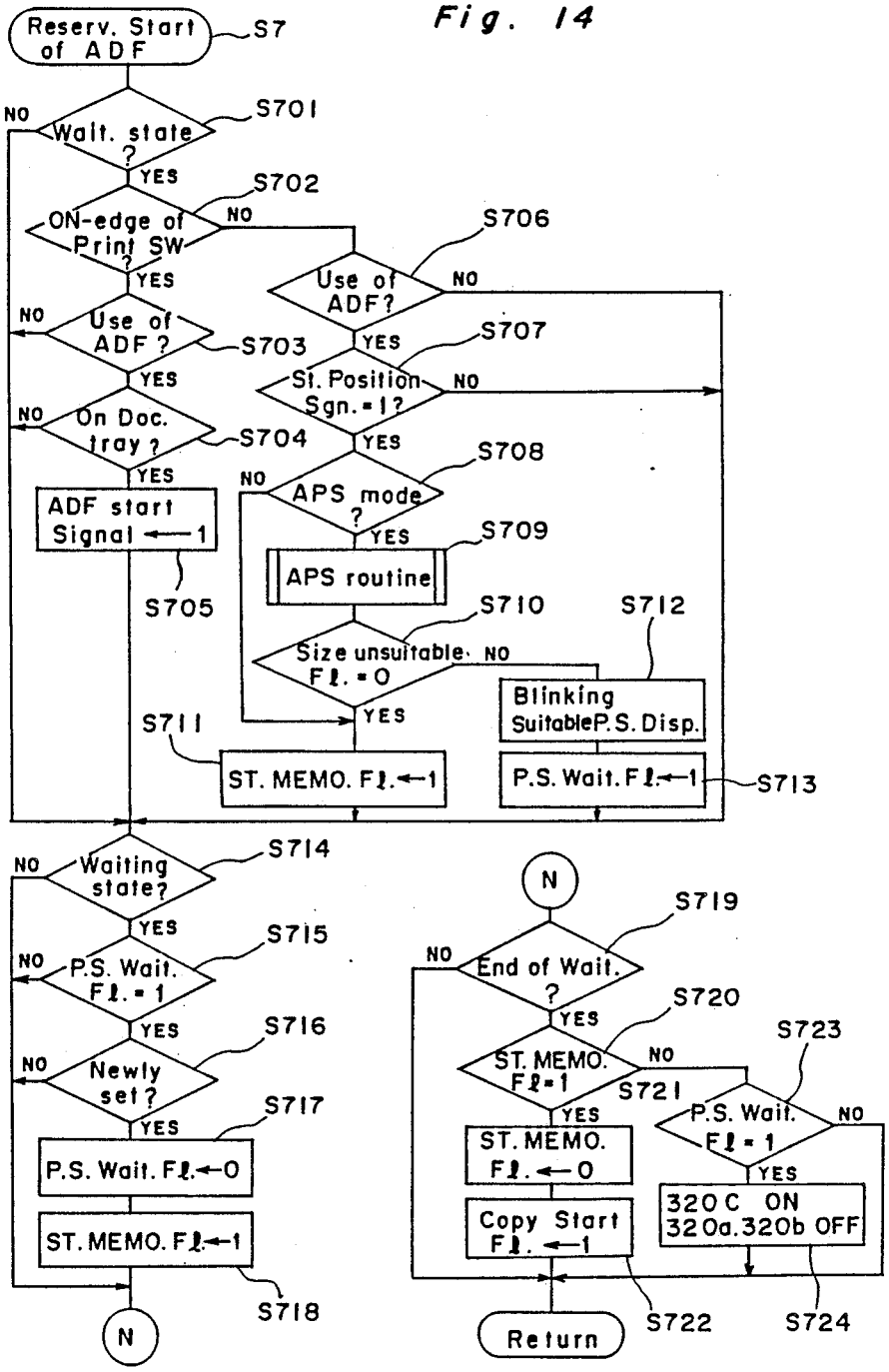
FIG. 14 is a flow chart of a subroutine for RESERVED START OF ADF.

FIG. 14 shows a flow chart of the subroutine S7 provided for reservation function for starting ADF.

In this subroutine S7, it is checked at first whether the copying machine is in the waiting state at step S701. If so, it is checked at ON-edge of the print switch 50 whether the ADF is used or not (steps S702 and S703). If the ADF is to be used, it is checked whether at least one document is put on the document tray 304 at step S704 and, then, ADF starting signal is set to "1" at step S705.

Figure 15:
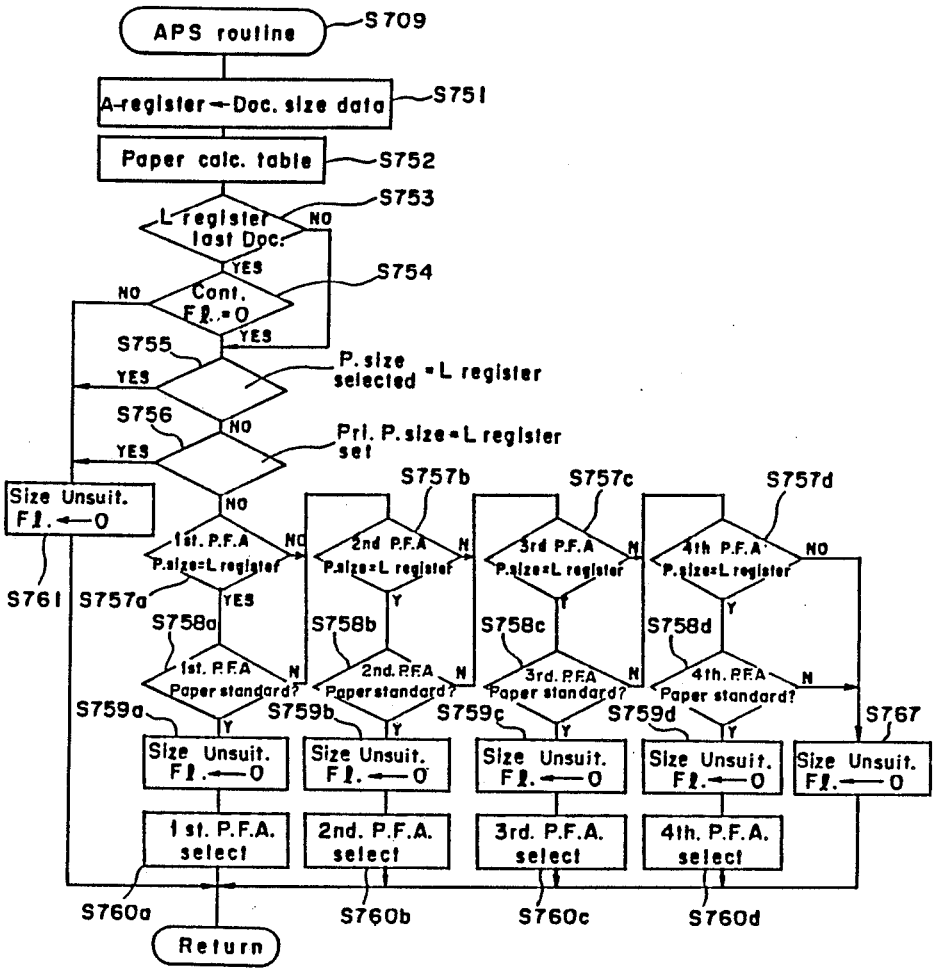
FIG. 15 is a flow chart of APS subroutine.

If ON-edge of the print switch 50 is not detected, it is checked whether the ADF is to be used or not at step S706. If it is to be used, the document is fed to the predetermined position and, therefore, the detection signal indicating that the document is positioned at the predetermined standard position is made "high" at step S707. Then, it is checked whether the APS mode is designated at step S708. If not, START-MEMORY flag is set to "1" at step S711. If the APS mode is designated, the auto-paper selection subroutine S709 of FIG. 15 is executed and it is checked whether SIZE UNSUITABLE flag is equal to zero at step S710. If SIZE UNSUITABLE flag is "0", START MEMORY flag is set to "1" at step S710. If it is not "0", one paper size display indicating a suitable paper size is blinked at step S712 and, then, WAIT flag for setting paper is set to "1" at step S713.

Next, when it is detected that a suitable paper size is newly set in the waiting state, provided that said WAIT flag is equal to "1" (steps S714, S715 and S716), the WAIT flag is reset to "0" at step S717 and the START-MEMORY flag is set to "1" at step S718.

Thereafter, when a finishing edge of waiting is detected at step S719, it is checked whether START-MEMORY flag is equal to "1" at step S720. If this START-MEMORY flag is equal to "1", it is reset to "0" at step S721 and COPY START flag is set to "1" at step S722. If it is not equal to "1", it is checked whether PAPER SET WAIT flag is equal to "1" at step S723. If the WAIT flag is equal to "1", LED display 320*c* is turned ON and other LED displays 20*a* and 320*b* are turned OFF to cancel the APS mode and to set the manual mode automatically.

FIG. 15 shows a flow chart of the auto-paper selection subroutine S709 to be executed in the subroutine S7 mentioned above. In this subroutine S709, data regarding to a document size sent from CPU 3 are stored in register A in CPU 1 at step S751 and, then, the paper size calculating subroutine which is shown in FIG. 10 is called at step S752.

In this subroutine S752, the most suitable paper size is found out at step S711, based on the document size detected and the width of copy magnification set in the APS magnification alteration subroutine S5 shown in FIG. 12 and, then, the paper size found out is memorized in a register L in CPU 1 at step S772.

If data stored in L-register are same to those of the latest document at step S753 and CONTINUOUS COPY flag indicating continuous copying mode for a plurality of documents is set to "1" at step S754, SIZE SUITABLE flag is reset to "0" at step S761. Namely, once the continuous copying for a plurality of documents having an identical size is started, the paper feeding aperture presently used is not changed to another one having a higher priority than that of the former even if copying papers having the identical size are set in the latter.

On the contrary to the above, in the case that the size of document is changed in the coarse of the continuous copying or the CONTINUOUS COPY flag is set to "0", the paper feeding aperture selected at first is checked at step S755 and, if copying papers having the most suitable size are set therein, the paper feeding aperture wherein copying papers are set at first, is selected as the top priority. Therefore, there is never caused such a situation giving confusion to the operator that the paper feeding aperture presently selected is switched to another one wherein copying papers of a size same to that of the former, although copying papers having the suitable size are set in the same. It is also possible to designate the predetermined paper feeding aperture wherein copying papers having the same size to that of another one but different in color therefrom.

Meanwhile, in the case that copying papers having the suitable size are not set in the paper feeding aperture selected at first, the paper feeding aperture having been given the priority by either one of priority set keys 503 through 506 is checked at step S756 and, if the paper size set therein is equal to the suitable size, said paper feeding aperture is selected.

If copying papers having the suitable paper size are not set in neither of the paper feeding apertures selected at first and having been given the priority, the paper size stored in A-register is compared with that of the first cassette 20 at step S757*a*. If the latter coincides with the former and the kind of paper in the first cassette is identified to be standard, namely both of sensors 401 and 402 are in OFF-state at step S758*a*, SIZE UNSUITABLE flag is reset to "0" at step S759*a* and, then, the first paper feeding aperture A is selected at step S760*a*.

If the paper feeding aperture A is not to be selected, the paper size stored in A register is compared with that of the second cassette 21 inserted in the second paper feeding aperture B at step S757*b*. If all of conditions set at step S758*b*, the second one B is selected at step S760*b* after resetting SIZE UNSUITABLE flag to "0" at step S759*b*. Similar processings are carried out with respect to the third and fourth paper feeding apertures C and D until a paper feeding aperture satisfying conditions set is found out.

If any paper feeding aperture which satisfies the conditions is not found out, SIZE UNSUITABLE flag is set to "1" at step S762.

(d-7) Copying operation

Figure 17A:
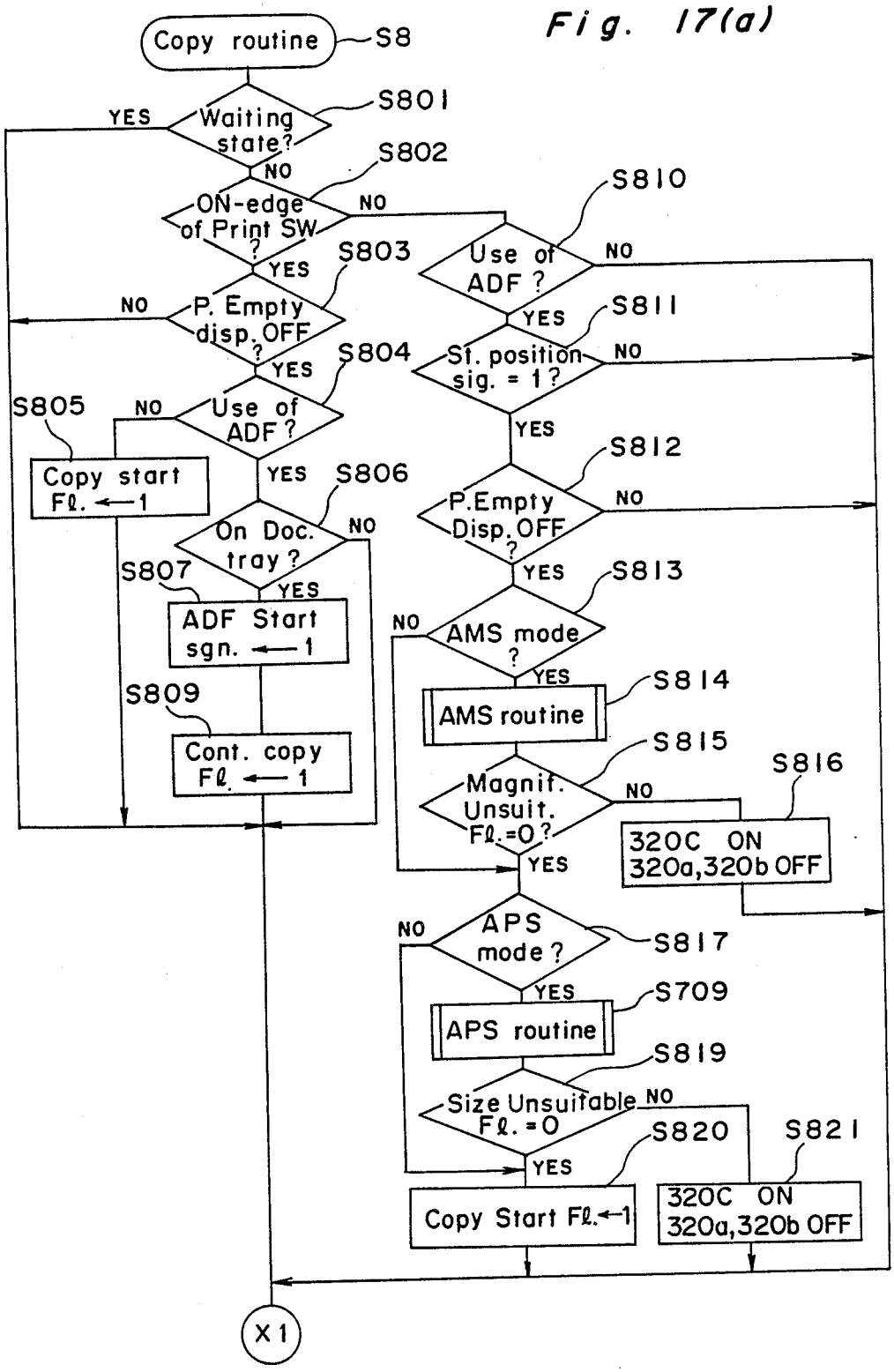
Figure 17B:
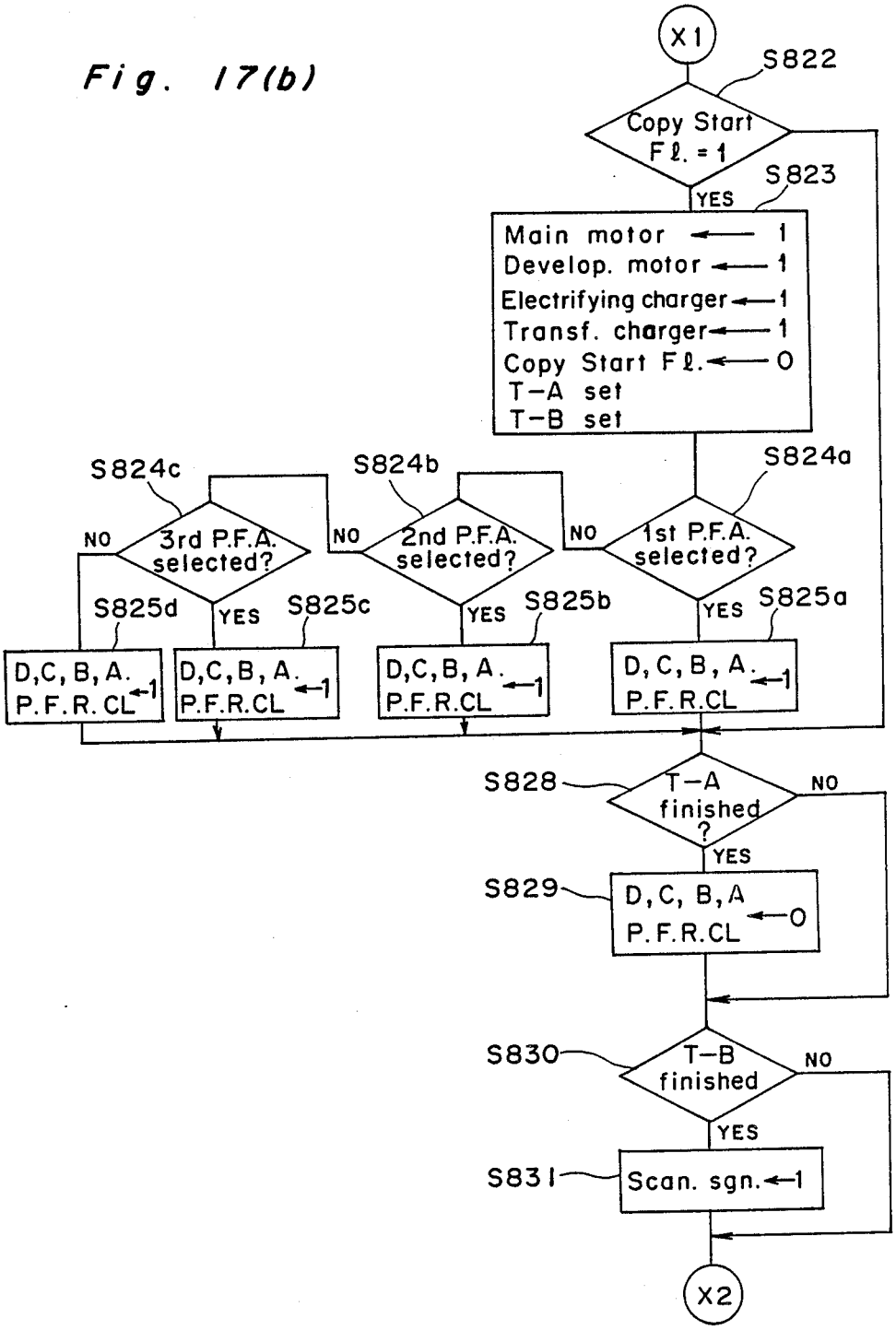
Figure 17C:
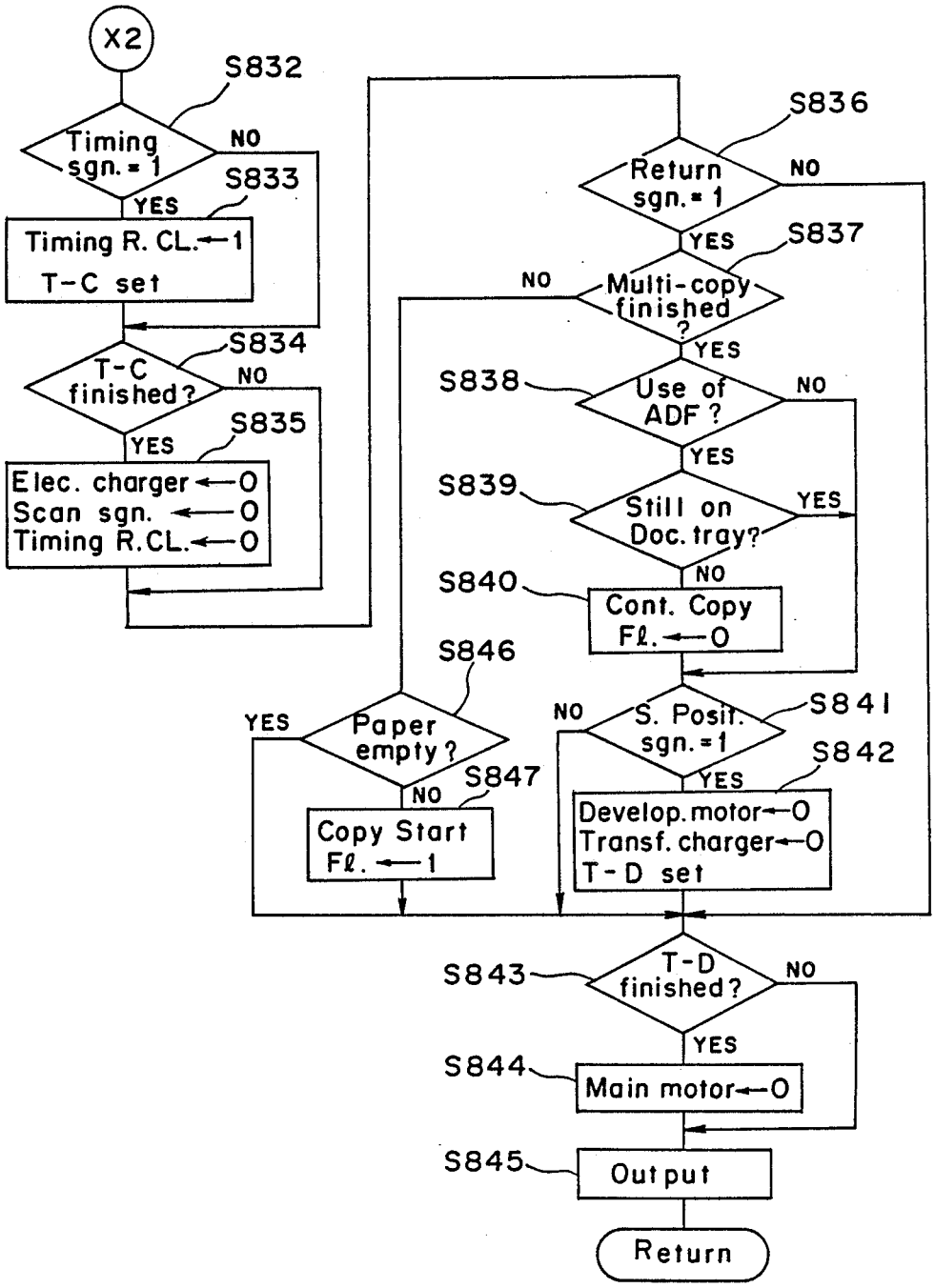

FIGS. 17(*a*), 17(*b*) and 17(*c*) show a flow chart of the copying operation routine.

As shown in FIG. 17(*a*), it is checked whether the copying machine is in the waiting state at step S801, since there is provided the reservation function for starting the ADF. If it is in the waiting state, the process proceeds to step S822 of FIG. 17(*b*). If it is not, it is checked whether the PAPER EMPTY display is in OFF state at ON-edge of the print switch 50 (step S802 and S803). If it is not and if the ADF is not in use (at step S804), COPY STARTING flag is set to "1" at step S805. If the ADF is in use, it is checked whether a document to be copied is on the document tray at step S806. If there is a document on the tray, ADF START signal for the ADF is set to "1" and CONTINUOUS COPY flag is set to "1" at steps S807 and S809.

If PAPER EMPTY display 52 is in ON-state at step S803, the process proceeds to step S822 of FIG. 17(*b*).

Further, if not at ON-edge of the print switch 50 at step S802 and if the ADF is in use at step S810, it is checked whether PAPER EMPTY display is in OFF-state at step S812. If PAPER EMPTY display is in ON-state, the process proceeds to step S822 of FIG. 17(*b*). If PAPER EMPTY display is in OFF-state at step S812, it is checked whether AMS mode is designated at step S813. If AMS mode is selected, AMS subroutine S814 is called at step S814 (See FIG. 18). If MAGNIFICATION UNSUITABLE flag is set to "1" as the result of execution of AMS subroutine at step S815, LED display 320*c* is turned ON and other LED displays 320*a* and 320*b* are turned OFF to switch ADF mode to manual mode automatically at step S816.

On the contrary to the above, if MAGNIFICATION UNSUITABLE flag is equal to "0" at step S815 and when APS mode is set at step S817, APS subroutine shown in FIG. 15 is executed at step S709.

If SIZE UNSUITABLE flag is set to "0" as the result of execution of APS subroutine at step S819, COPY-START flag is set to 1 at step S820. If it is set to "1", LED display 320*c* is turned ON and other LED display 320*a* and 320*b* are turned OFF to switch ADF mode to manual mode at step S821.

Since ADF mode is automatically switched to manual mode, one can obtain a copy by operating the print switch though it does not have the most suitable size, if he feels it bothersome to select the most suitable paper size. Otherwise, he can obtain a copy of the most suitable size by setting it if he wishes.

Foregoing copy-operation is same to that of the conventional copying machine. Namely, when COPY-START flag becomes "1" at step S822 in FIG. 17(*b*), the main motor M1, the motor for the developing apparatus, the electrifying charger, the transferring charger and so on are switched ON, COPY-START flag is reset to "0" and timers T-A and T-B are set to start at step S823. If the first paper feeding aperture A is selected at step S824*a*, a clutch (not shown in FIG. 1) for the paper feeding roller 22 is switched ON at step S825*a*. If the second paper feeding aperture B is selected at step S824*b*, a clutch (not shown) for the paper feeding roller 23 is switched ON at step S825*b*. Similarly, if the third paper feeding aperture C is selected at step S824*c*, a clutch (not shown) for the paper feeding roller 220 is switched ON at step S825*c*. Also, if the fourth paper feeding aperture D is selected at step S824*d*, a clutch (not shown) for the paper feeding roller 230 is switched ON.

It is checked at step S828 whether the timer T-A is finished and, at finishing timing thereof, the clutch having been switched ON is switched OFF at step S829. When the timer T-B is finished at step S830, SCAN signal is made N at step S831.

When TIMING signal becomes "1" at step S832 in FIG. 17(*c*), a timing roller clutch (not shown) is switched ON and a timer T-C is set to start at step S833. When the timer T-C times up at step S834, the electrifying charger and timing roller clutch are switched OFF and SCAN signal is reset at step S835.

If RETURN signal for the optical system becomes "1" at step S836, namely, the optical system is started to return, it is checked whether copy operation for multi-copy has been finished or not at step S837. If not, PAPER EMPTY flag is checked at step S846. If the flag is not set, COPY START flag is set to "1" at step S847.

If multi-copy operation is finished, CONTINUOUS COPY flag is reset to "0" at step S840 when the next document is not on the document platen during use of the ADF at step S839. If the ADF is not in use and when there is the next document on the document platen at step S839, CONTINUOUS COPY flag is not reset to "0".

When the standard position switch SW50 is switched ON by the scanning system returned thereto, the developing motor and the transferring means are stopped and a timer T-D is set at step S812.

If the timer T-D times up at step S843, the main motor M1 is stopped at step S844 and, then, all of results obtained through those processes mentioned are outputted at step S845.

Figure 18:
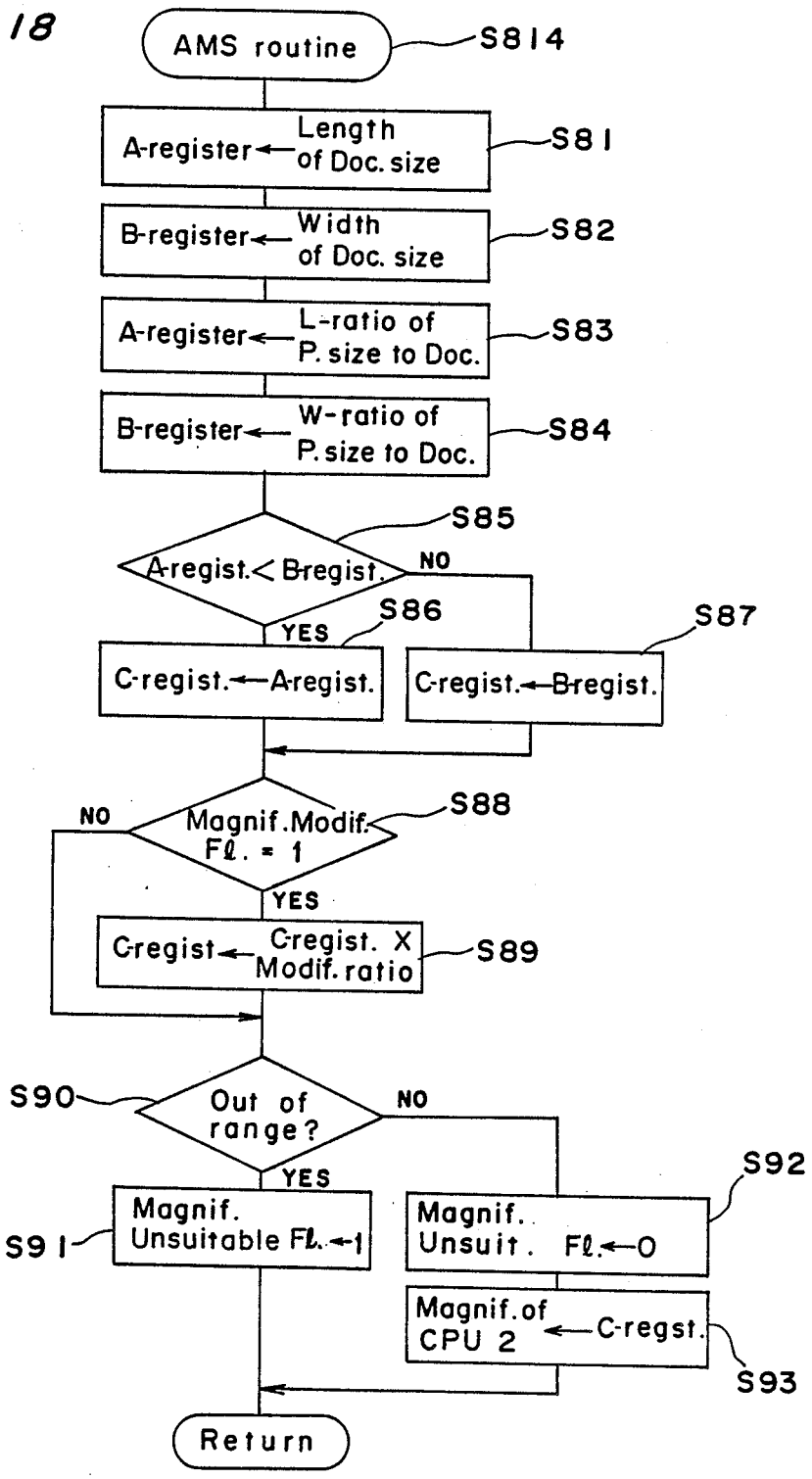
FIG. 18 is a flow chart of AMS (auto-magnification select) subroutine, FIGS. 19(*a*) and 19(*b*) show a flow chart of main routine to be executed by CPU 3 for controlling ADF.

AMS subroutine S814 is well disclosed in FIG. 18.

In this AMS subroutine S814, data of the longitudinal length of a document which are detected and sent by CPU 3 are stored into the register A in CPU 1 at step S81. Similarly, data of the sideways length of the document are stored into the register B in CPU 1 at step S82.

Next, at step S83, the longitudinal length of the paper size selected is divided by the longitudinal of the document stored in A-register and the resulted magnification is restored in A-register. Similarly, the sideways length of the former is divided by the sideways one of the latter and the resulted magnification is restored in B-register at step S84.

Next, these two magnifications are compared with each other at step S85 and smaller one is stored in C-register at step S86 or S87.

Then, it is checked whether MAGNIFICATION ALTERATION flag is equal to "1" at step S88. If it is equal to "1", the value obtained by multiplying the value of C-register by the modification ratio having been set is restored in C-register and, if it is equal to "0", the value of C-register is stored again in C-register at step S89.

Next, at step S90, it is decided whether the value of C-register obtained is out of the range defined between the maximum magnification and the minimum one which can be attained by the optical system of the copying machine.

If it is out of the range, MAGNIFICATION UNSUITABLE flag is set to "1" at step S91. If it falls in the range, the flag is set to "0" at step S92 and, at step S93, it is sent to CPU 2.

(e) Operation of ADF (Communication with other CPUs)

Figure 19A:
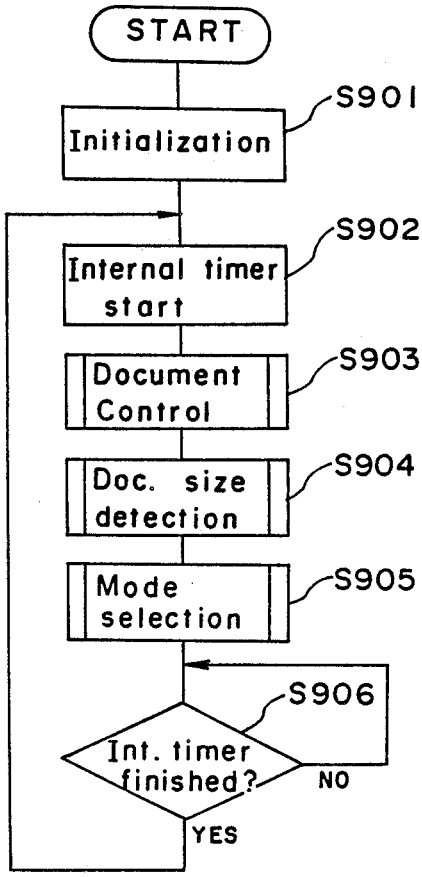
Figure 19B:
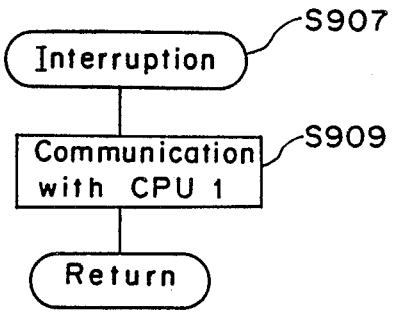

FIGS. 19(*a*) and 19(*b*) show a flow chart of the program to be executed by CPU 3 which controls the ADF 300.

When the program is started by resetting CPU 3, it is initialized by clearing up RAM therein, and setting various registers and individual devices in the ADF are set to respective initial modes at step S901.

Then, at step S902, an internal timer is started which is provided in CPU 3 and has been set to an initial value at step S901.

Thereafter, DOCUMENT CONTROL subroutine, DOCUMENT SIZE DETECTION subroutine and MODE SELECT subroutine are executed at steps S903, S904 and S905, respectively. When all these subroutines have been executed, one routine is finished at the timing that the internal timer times up (at step S906). The time interval of one routine is utilized for timing various timers provided in subroutines mentioned above. In other words, each timer counts the number of routines repeated in order to determine a finishing timing thereof.

As shown in FIG. 19(*b*), data communication between CPU 3 and CPU 1 is done by an interrupt routine irrespective of the main routine when an interruption is demanded from CPU 1.

Figure 20:
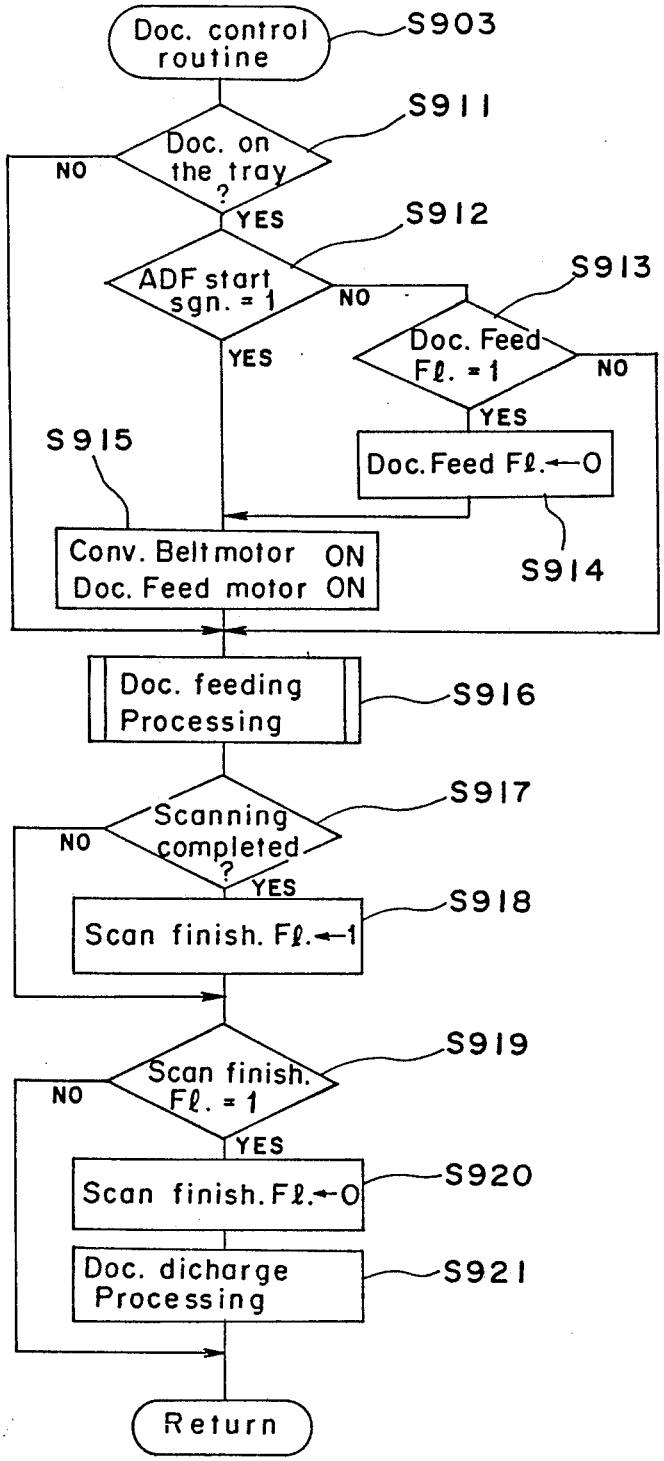
FIG. 20 is a flow chart of DOCUMENT CONTROL subroutine.

FIG. 20 shows a flow chart of DOCUMENT CONTROL subroutine S903.

When ADF START signal from CPU 1 becomes "1" at step S912 or when DOCUMENT FEEDING flag becomes "1" at step S913, provided that documents are on the document tray 304, namely the document detection sensor 311 is in ON-state, the motor 301 for driving the transporting belt and the motor 302 for feeding a document are switched ON at step S915 after making DOCUMENT FEEDING flag reset to "0" at step S914.

Then, DOCUMENT FEEDING subroutine (See FIG. 21) is executed at step S916.

Next, SCAN FINISHING flag is set to "1" at step S918 when scanning operation has been repeated by the number of documents set on the document tray at step S917.

If SCAN FINISHING flag is set to "1" at step S919, it is reset to "0" at step S920 and, then, DOCUMENT DISCHARGING subroutine (See FIG. 22) is executed at step S921.

Figure 21:
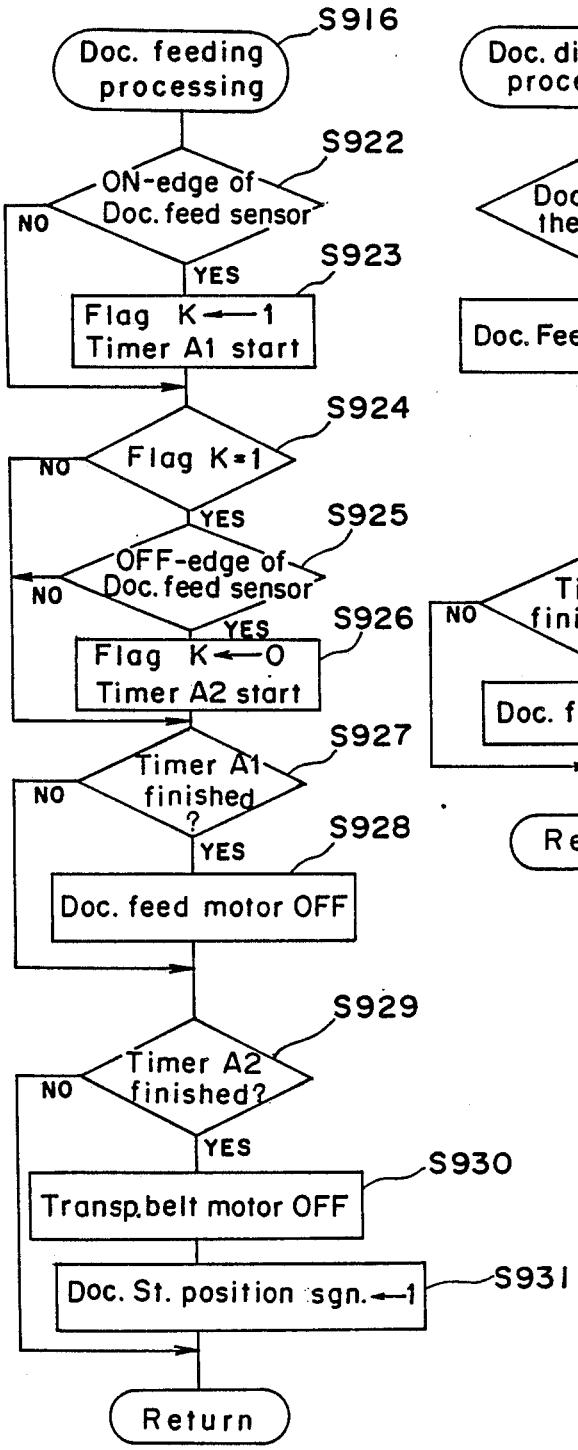
FIG. 21 is a flow chart of DOCUMENT FEEDING subroutine.

FIG. 21 shows a flow chart of DOCUMENT FEEDING subroutine.

When DOCUMENT FEEDING sensor 310 is made ON by feeding a document a step S922, flag K is set to "1" and timer A1 is started at step S923. This timer A1 is used for stopping the document feeding motor 302 in order to prevent undue feed of the next document after one document has been fed. In order for that, the timer A1 is so set as to time up when said one document is fed to a position to which it is fed by the transporting belt 305. If flag K is set to "1" at step S924, when OFF-edge of the document feeding sensor 310 is detected, namely, the rear end of the document is detected, it is reset to "0" and timer A2 is started at step S926. The value of timer A2 is set to a time needed until the rear end of the document is attained to a predetermined position on the document glass platen.

When timer A1 times up at step S927, the document feeding motor 302 is stopped at step S928. Further, when timer A2 times up at step S929, the transporting belt motor 301 is stopped at step S930 and, then DOCUMENT STANDARD POSITION signal is sent to CPU 1 at step S931.

Figure 22:
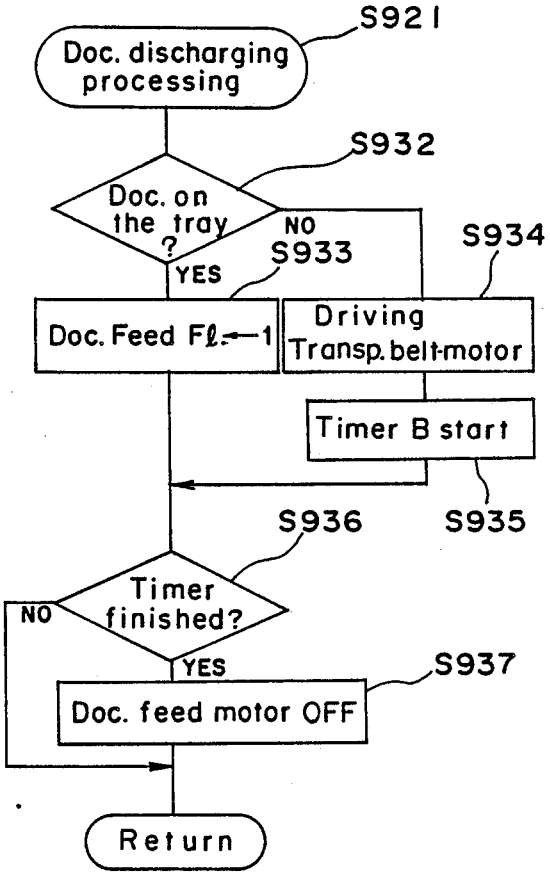
FIG. 22 is a flow chart of DOCUMENT DISCHARGING subroutine.

FIG. 22 shows a flow chart of DOCUMENT DISCHARGING subroutine S921.

If it is detected by the document detection sensor 311 that there is at least one document to be copied on the document tray at step S932, DOCUMENT FEEDING flag is set to "1" at step S933. If not, the transporting belt motor 305 is started to rotate in the normal direction at step S934 and, then, timer B is started at step S935. Timer B has set to have enough time for discharging the document on the document platen even if it has the longest length permitted in the copying machine. When timer B times up, the transporting belt motor 301 is turned OFF at step S937.

Figure 23:
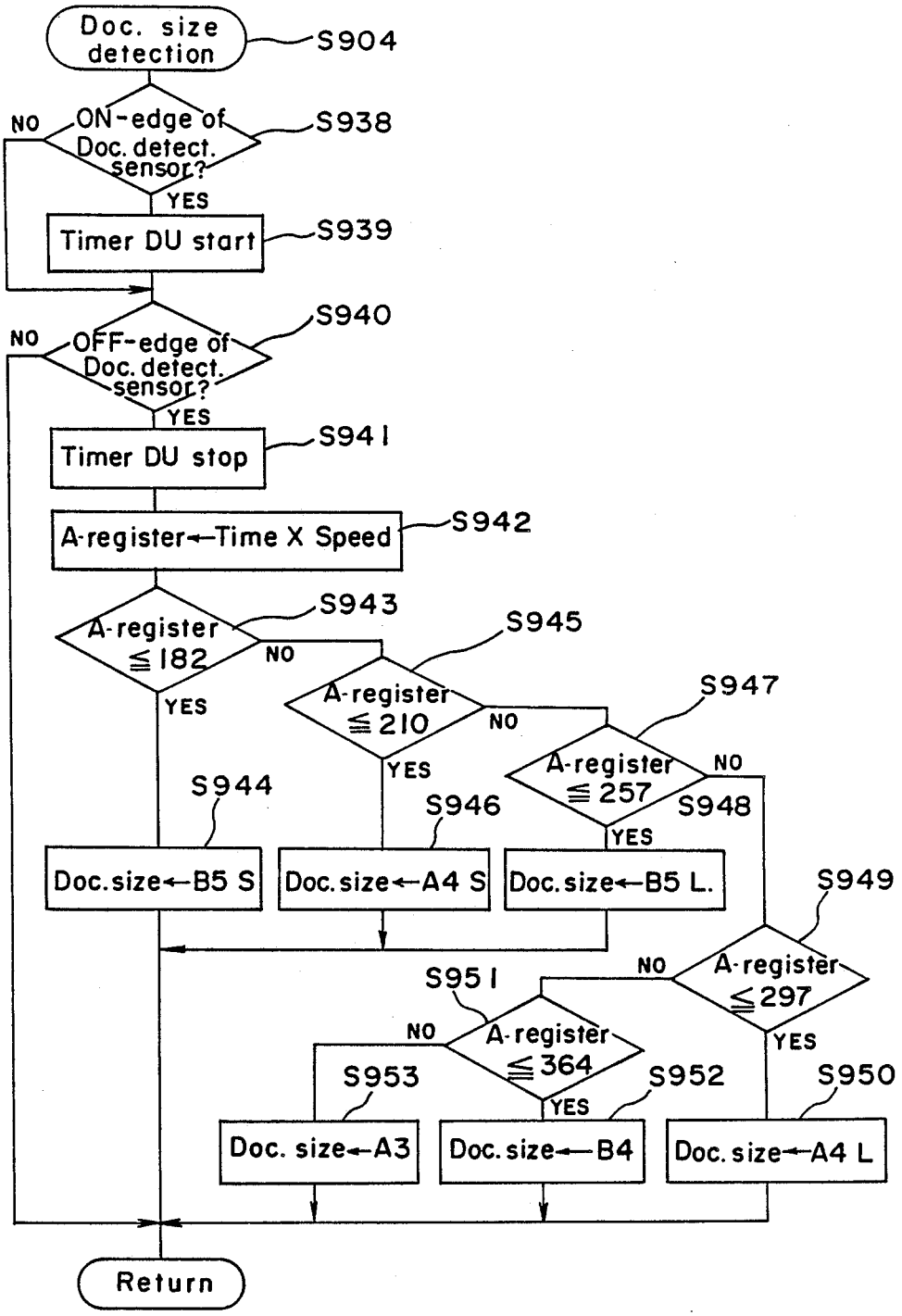
FIG. 23 is a flow chart of DOCUMENT SIZE DETECTION subroutine.

FIG. 23 shows a flow chart of DOCUMENT SIZE DETECTION subroutine S904.

When the document detection sensor 311 detects the top end of the document at step S938, timer DU is started at step S939. Next, as soon as the bottom end of the document passes the sensor step S940, timer DU is stopped at step S941. The length of the document is obtained as a product of the time measured by timer DU by a feeding speed thereof. This length obtained is stored in A-register at step S942. If the value stored in A-register is smaller than or equal to "182" (mm) at step S943, the document size is determined to be "B5 sideways set" at step S944. If it is smaller than or equal to "210" (mm) at step S945, the document size is determined to be "A4 sideways set" at step S946. Similarly, if it is smaller than or equal to "210" (mm) at step S947, the document size is "B5 lengthwise set" at step S948 and, if it is smaller than or equal to "257" (mm) at step S949, the document size is determined to be "A4 lengthwise set". Also, if it is smaller than or equal to "364" (mm) at step S951, the document size is determined to be "B4" and, if it is larger than "364" (mm) at step S952, the document size is determined to be "A3" at step S953.

In order to determine the document size more accurately, one more sensor can be arranged aside the sensor 310 for discriminating documents having same length but different width for example papers of "A4 sideways set" and "A5 lengthwise set".

Figure 24:
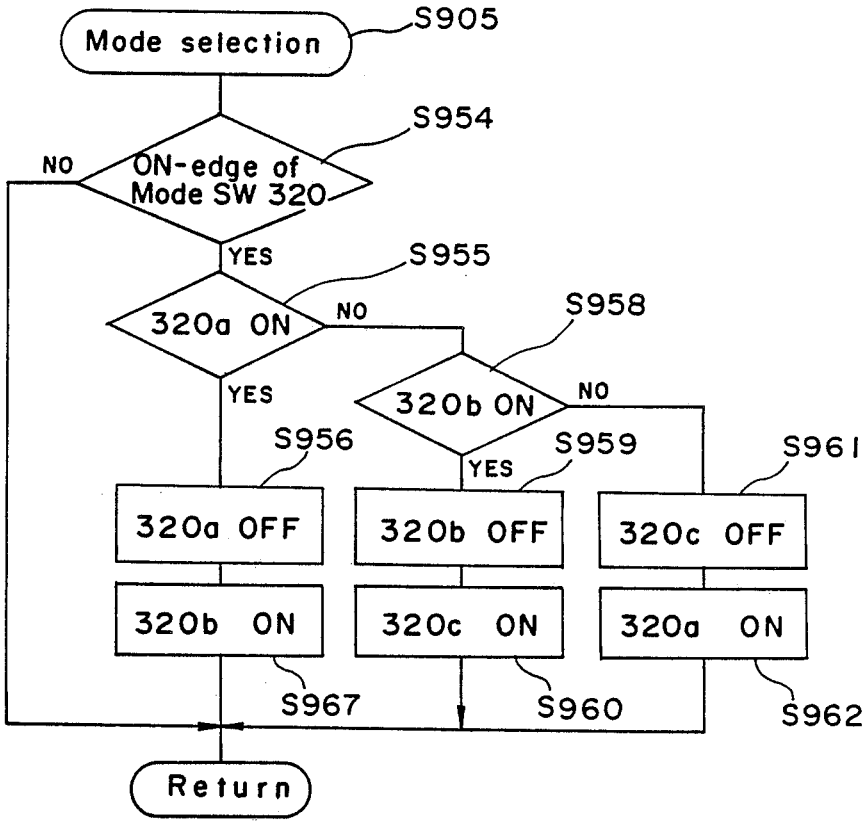
FIG. 24 is a flow chart of MODE SELECT subroutine.

FIG. 24 shows a flow chart of MODE SELECTING subroutine S905.

When the mode selecting switch 320 is turned ON, the AMS mode is selected if it is detected at ON-edge of the switch 320 that LED display 320 is turned ON, namely the APS mode is selected (at steps S954, S955, S956 and S957). If LED display 320*b* is turned ON, namely the AMS mode is selected, the mode is switched to the manual mode (at steps S958, S959 and S960).

In cases other than those mentioned above, the mode is switched to the APS mode at steps S961 and S962.

In the preferred embodiment, either one of the first to the fourth paper feeding apertures can be set as a preference one with use of keys 503 through 506, but it is also possible to select one of them in the order of them predetermined, for example in the priority order of the first one, the third one, the second one and the fourth one. In order to set the priority order mentioned above, ten keys 60 to 69 for setting the number of copy can be utilized.

Further, when "paper empty" at the fourth paper feeding aperture is detected in the case that such order as mentioned just above is set, it is possible that search is made in order to find out one paper feeding aperture wherein a cassette containing copying papers having a paper size same to that of the fourth one and, if it is found out, the paper feeding aperture found out is selected to continue residual copying operation.

The preferred embodiments described herein are illustrative and not restrictive, the scope of the invention being indicated by the appended claims and all variations which come within the meanings of the claims are intended to be embraced herein.

What is claimed is:

1. A copying machine comprising:

means being capable of forming an image of a various magnifications, a plurality of copying paper feeding means, means for detecting the size of a document to be copied, first designation means for designating a magnification for copying, means for calculating the most suitable paper size based upon the document size detected by said detection means and the magnification designated by said first designation means, second designation means for manually designating at least one paper feeding means to be used preferentially among said plurality of paper feeding means, means for selecting the paper feeding means designated by said second designation means when copying papers contained therein have the size calculated by said calculation means, and means for selecting one paper feeding means in which copying papers having the size calculated by said calculation means among paper feeding means other than the paper feeding means designated by said second designation means when said copying papers of said size are not contained in the latter.

2. A copying machine according to claim 1 further comprising means for warning when copying papers having the size calculated by said calculation means are contained in neither of said plural paper feeding means.

3. A copying machine according to claim 1 further comprising means for displaying a size of copying paper which is contained in the selected paper feeding means.

4. A copying machine comprising:

image forming means, a plurality of copying paper feeding means, means for detecting the size of a document to be copied, means for calculating the most suitable paper size based upon the document size detected by said detection means, means for manually designating at least one paper feeding means to be used preferentially among said plurality of paper feeding means, means for selecting the paper feeding means designated by said designation means when copying papers contained therein have the size calculated by said calculated means, and means for selecting one paper feeding means in which copying papers having the size claculated by said calculation means among paper feeding means other than the paper feeding means designated by said designation means when said copying papers of said size are not contained in the latter.

5. A copying machine comprising:

means being capable of forming an image of a document at various magnifications, a plurality of copying paper feeding means, means for detecting individual sizes of copying papers which are contained in individual paper feeding means, means for selecting one of those paper feeding means manually, first designation means for manually designating at least one paper feeding means to be used preferentially, means for detecting the size of a document to be copied, second designation means for designating a magnification for copying, means for calculating the most suitable paper size based upon the document size detected by said detection means and the magnification designated by said second designation means, means for operating the paper feeding means selected by said manual selection means if copying papers having the size calculated by said calculation means are contained therein, means for operating the paper feeding means designated by said first designation means is copying papers having the size calculated by said calculation means are contained therein although they are not contained in the one selected by said manual selection means, and means for operating one of the rest other than the designated and selected paper feeding means if copying papers having the calculated size are contained in neither of the latter two but in the former one.

6. A copying machine according to claim 5 further comprising means for warning when copying papers having the calculated size are contained in neither of said plural paper feeding means.

7. A copying machine according to claim 5 further comprising means for displaying a size of copying paper which is contained in the selected paper feeding means.

8. A copying machine comprising:

means being capable of forming an image of a document at various magnifications, a plurality of copying paper feeding means, first detection means for detecting individual sizes of copying papers which are contained in individual paper feeding means, means for selecting one of those paper feeding means manually, means for designating at least one paper feeding means to be used preferentially, second detection means for detecting the size of a document to be copied, means for calculating the most suitable paper size based upon the document size detected by said second detection means, means for operating the paper feeding means selected by said manual selection means if copying papers having the size calculated by said calculation means are contained therein, means for operating the paper feeding means designated by said designation means if copying papers having the size calculated by said calculation means are contained therein although they are not contained in the one selected by said manual selection means, and means for operating one of the rest other than the designated and selected paper feeding means if copying papers having the calculated size are contained in neither of the latter two but in the former one.

9. A copying machine comprising:

means being capable of forming an image of a document at various magnifications, a plurality of copying paper feeding means, means for selecting one of said plural copying paper feeding means manually, means for detecting a size of a copying paper contained in each paper feeding means, means for detecting the size of a document to be copied, means for designating a magnification for copying, means for calculating the most suitable paper size based upon the document size detected by said detection means and the magnification designated by said designation means, means for entering priority order of respective paper feeding means to be used, first means for operating the paper feeding means selected by said selection means if copy papers having the size calculated by said calculation means are contained therein, and second means for operating the paper feeding means having top priority among plural paper feeding means except for the selected one if copying papers having the size calculated by said calculation means are contained therein in the case that they are not contained in the one selected by said selection means.

10. A copying machine according to claim 9 in which said entry means is a key for setting the number of copy.

11. A copying machine according to claim 9 in which, when the paper feeding means being operated becomes empty, said second means selects and operates the paper feeding means having top priority among the rest except for the empty one, wherein copying papers of the calculated size are contained.

12. A copying machine comprising:

means being capable of forming an image of a document at various magnifications, a plurality of copying paper feeding means, means for selecting one of said plural copying paper feeding means manually, means for detecting a size of a copying paper contained in each paper feeding means, means for detecting the size of a document to be copied, means for calculating the most suitable paper size for the document size detected by said detection means, means for manually entering priority order of respective paper feeding means to be used, first control means for operating the paper feeding means selected by said selection means if copying papers having the size calculated by said calculation means are contained therein, and means for operating the paper feeding means having top priority among plural paper feeding means except for the selected one if copying papers having the size calculated by said calculation means are contained therein in the case that they are not contained in the one selected by said selection means.

13. A copying machine comprising:

means being capable of forming an image of a document at various magnifications, a plurality of copying paper feeding means, first detection means for detecting a size of a copying paper contained in each paper feeding means, second detection means for detecting the size of a document to be copied, means for designating a magnification for copying, means for calculating the most suitable paper size based upon the document size detected by said second detection means and the magnification designated by said designation means, means for entering priority order of respective paper feeding means, and means for selecting one of plural paper feeding means having top priority among them if it contains copying papers of the calculated size.

14. A copying machine comprising:

image forming means, a plurality of copying paper feeding means, first detection means for detecting a size of a copying paper contained in each paper feeding means, second detection means for detecting the size of a document to be copied, means for calculating the most suitable paper size for the document size detected said second detection means, means for manually entering priority order of respective paper feeding means, and means for selecting one of plural paper feeding means having top priority among them if it contains copying papers of the calculated size.

15. A copying machine comprising:

a plurality of paper feeding means, a glass platen for setting a document thereon, means for copying the image of document set on the glass platen on a copying paper fed by one of plural paper feeding means, auto-document feeder for feeding documents put on a document tray one by one onto the glass platen and for setting the next one on the glass platen after discharging the present one when the copying operation thereof has been completed, means for controlling said auto-document feeder and copying means in such a manner that documents set on the document tray are copied successively by starting to drive the copying means when a document is set on the glass platen by said auto-document feeder and by starting to drive the latter when the former has completed the operation thereof, first detection means for detecting the size of a document set on the glass platen, second detection means for detecting a size of a paper contained in each paper feeding means, means for designating a magnification for copying, means for calculating the most suitable size of copying paper based on the document size detected by said first detecting means and the magnification designated by said designating means, means for priority manually entering of respective paper feeding means, means for selecting one paper feeding means having top priority among plural paper feeding means wherein copying papers of the calculated size are contained, and means for operating said selection means only when change in the document size is detected during execution of successive copying by said first control means.

16. A copying machine comprising:

means being capable of forming an image of a document at various magnifications, a plurality of paper feeding means, means for detecting individual paper sizes of copying papers contained in respective paper feeding means, means for detecting whether copying papers are contained in each paper feeding means or not, document size detection means, means for designating a magnification for copying, means for manually priority order of respective plural paper feeding means, means for calculating the most suitable size of copying paper based on the detected document size and the designated magnification, means for starting operation of the image forming means after selecting one of paper feeding means in which copying papers of the calculated size are contained, and means for selecting one of plural paper feeding means except for the selected one having top priority among them wherein copying papers of the same size are contained when said selected one becomes empty during execution of forming an image.

* * * * *